US011885052B2

(12) United States Patent
Laberge Lebel et al.

(10) Patent No.: US 11,885,052 B2
(45) Date of Patent: Jan. 30, 2024

(54) BRAIDING MACHINES AND CARRIERS FOR BRAIDING MACHINES

(71) Applicant: POLYVALOR, LIMITED PARTNERSHIP, Montreal (CA)

(72) Inventors: Louis Laberge Lebel, Montreal (CA); Pascal Assi, Montreal (CA); Cristian Stefan Talos, Montreal (CA); Guillaume Villeneuve, Châteauguay (CA); Olivier Chabot, Val-d'Or (CA); Philippe Bousquet, Montreal (CA); Vincent Delisle, Notre-Dame-de-l'Île-Perrot (CA)

(73) Assignee: POLYVALOR, LIMITED PARTNERSHIP, Montreal (CA)

( * ) Notice: Subject to any disclaimer, the term of this patent is extended or adjusted under 35 U.S.C. 154(b) by 0 days.

(21) Appl. No.: 17/493,242

(22) Filed: Oct. 4, 2021

(65) Prior Publication Data

US 2022/0106716 A1 Apr. 7, 2022

Related U.S. Application Data

(60) Provisional application No. 63/086,871, filed on Oct. 2, 2020.

(51) Int. Cl.

| | |
|---|---|
| ***D04C 3/16*** | (2006.01) |
| ***D04C 3/24*** | (2006.01) |
| ***D04C 3/48*** | (2006.01) |
| ***D04C 3/38*** | (2006.01) |
| ***D04C 3/20*** | (2006.01) |

(52) U.S. Cl.
CPC ..... *D04C 3/16* (2013.01); *D04C 3/20* (2013.01); *D04C 3/24* (2013.01); *D04C 3/38* (2013.01); *D04C 3/48* (2013.01)

(58) Field of Classification Search
CPC ... D04C 3/16; D04C 3/18; D04C 3/20; D04C 3/24; D04C 3/38; D04C 3/48
See application file for complete search history.

(56) References Cited

U.S. PATENT DOCUMENTS

| | | | | |
|---|---|---|---|---|
| 5,348,056 A * | 9/1994 | Tsuzuki | ..... | D04C 1/06 139/384 R |
| 6,439,096 B1 * | 8/2002 | Mungalov | ..... | D04C 1/06 87/50 |
| 2018/0105963 A1 * | 4/2018 | Quick | ..... | D04C 3/40 |

* cited by examiner

*Primary Examiner* — Shaun R Hurley
(74) *Attorney, Agent, or Firm* — NORTON ROSE FULBRIGHT CANADA LLP

(57) ABSTRACT

A carrier for supporting a yarn to be used by a braiding machine, has: a spool carrying the yarn; a motor drivingly engaged to the spool; at least one sensor for producing data about a condition of the yarn in the spool; and a controller operatively connected to the motor and to the at least one sensor, the controller having a processor and a computer-readable medium operatively connected to the processor and having instructions stored thereon executable by the processor for: receiving said data from the at least one sensor; determining operation parameters of the motor based on the received data; and operating the motor per the determined operation parameters to create the desired tension in the yarn.

9 Claims, 18 Drawing Sheets

BRAIDING MACHINES AND CARRIERS FOR BRAIDING MACHINES

TECHNICAL FIELD

This disclosure generally relates to the field of braided yarn manufacturing and more particularly to braiding systems and methods and to carriers carrying yarns to be braided.

BACKGROUND OF THE ART

Composite materials are made using textiles made of rigid and resistant fibers, such as carbon fibers and glass fibers, combined to polymers. These textiles are made of fibers, or yarns of fibers, that are assembled to form felts, fabrics, weaves, braids, ropes, unidirectional ribbons, using different fabrication techniques. Braiding machines are typically used for manufacturing ropes and laces. They may be used to manufacture textiles that can form composite materials for various uses, such has aircraft fuselages, pipes, and beams. These braiding machines carry yarns to be braided on spools.

Different techniques of braiding have a common ground: the unwinding of the spools under tension to ensure that the different yarns do not tangle with one another. The different systems used to control the tension in the yarns may not provide a uniform and constant tension during the braiding process, especially when higher speeds are involved. Increases in tension may create shocks on the yarns. These shocks may lead to premature wear of the yarns.

Moreover, the spools carrying the yarns to be braided follow a predefined path. This predefined path creates variations in the distance between the spools and braiding locations. In some cases, this variation in distances may be too high for the tension control system of the spooled yarns to adapt. That may create tension variation in the yarns. This predefined path also prevent independent movements of the spools and prevent variation in geometry of the braid.

Improvements are therefore sought.

SUMMARY

A braiding machine architecture that may allow a completely independent carrier movement is presented. The machine may allow controlling the position of each intertwining yarn to create a three dimensional braid. Each carrier or spool can move without affecting the position of neighbouring carriers. This may allow an easier and total control on the position and morphology of each intertwining yarn.

An alternative to typical horn gear design is disclosed. Gears are independently driven. A carrier path can be divided into multiple pre-defined unitary displacements. Driven by the gears, the carriers follow these successive unitary displacements. This may allow 3D-printing textile composites with tailorable mechanical properties.

A braiding machine architecture allowing a completely independent carrier movement while removing the layer of complexity added by the current switching devices driven independently from the horn gears is presented. By enabling an independent movement of the carrier, each carrier may be moved separately without affecting the positions of its neighbors. Yarns may be added or removed from the braid without any human intervention slowing down the process and the braid architecture may no longer be limited by the braiding machine.

In one aspect, there is provided a carrier for supporting a yarn to be used by a braiding machine, comprising: a spool carrying the yarn; a motor drivingly engaged to the spool; at least one sensor for producing data about a condition of the yarn in the spool; and a controller operatively connected to the motor and to the at least one sensor, the controller having a processor and a computer-readable medium operatively connected to the processor and having instructions stored thereon executable by the processor for: receiving said data from the at least one sensor; determining operation parameters of the motor based on the received data; and operating the motor per the determined operation parameters to create the desired tension in the yarn.

In some embodiments, the receiving of the data includes receiving data about a quantity of yarn remaining around the spool.

In some embodiments, the at least one sensor is a potentiometer engaged to an arm pivotably mounted to a housing of the carrier supporting the spool, a distal end of the arm biased in abutment against the yarn of the spool, the distal end of the arm movable toward the spool as the yarn is consumed, the receiving of the data about the quantity of the yarn includes receiving a signal from the potentiometer indicative of the quantity of the yarn remaining.

In some embodiments, the determining of the operation parameters includes determining a torque generated by the motor.

In some embodiments, the determining of the torque includes determining a current to be supplied to the motor to achieve the determined torque.

In some embodiments, the receiving of the data includes receiving data about an angular position of the motor.

In some embodiments, an encoder is operatively coupled to the motor and to the controller, the receiving of the data includes receiving the angular position of the motor from the encoder.

In some embodiments, a battery is operatively connected to the controller and to the motor, the battery located within a housing of the carrier, the spool rollingly engaged to the housing.

In some embodiments, the controller is further configured for transmitting data about the tension in the yarn.

In some embodiments, the spool is disposed around the motor, a shaft of the motor supported by two arms protruding from a housing, the spool rollingly engaged to the housing via the two arms.

In some embodiments, an end of the spool is rollingly engaged to a housing, the spool sized to receive therein a bobbin of the yarn from an opposed free end of the spool, the spool having a tightening mechanism to secure the bobbin to the spool for concurrent rotation.

In another aspect, there is provided a braiding machine, comprising: a support structure; a matrix of gears supported by the support structure, the gears being rotatable about respective rotation axes, the gears engageable to a carrier carrying a yarn for moving the carrier on the support structure, at least some of the gears of the matrix arranged to form a path between a pair of adjacent ones of the gears to lead to at least two distinct paths, the at least two distinct paths defined by pairs of adjacent ones of the gears; bidirectional motors drivingly engaged to at least some of the gears; and a controller operatively connected to the motors, the controller having a processor and a computer-readable medium operatively connected to the processor and having instructions stored thereon executable by the processor for individually controlling the gears by powering the motors for moving the carriers on the support structure to braid the yarns.

In some embodiments, chains each having at least three rollers are interconnected by at least two arms, the at least two arms pivotable one relative the other about at least one pivot axis normal to the plane, the at least three rollers engageable within notches of the gears for moving the chains on the support structure.

In some embodiments, the carriers have spools carrying the yarns to be braided, the carriers secured to the chains.

In some embodiments, the controller is configured for obtaining data about a desired braid geometry.

In some embodiments, the obtaining of the data includes obtaining data about a sequence of movements of the gears to move the carriers engaged to the gears to obtain the desired braid geometry.

In some embodiments, each of the gears has from five to twenty four notches.

In some embodiments, a diameter of the notches corresponds to a diameter of the rollers, a depth of the notches corresponding to a radius of the rollers.

In some embodiments, the gears of the matrix are equidistantly spaced from one another.

In some embodiments, the gears of the matrix are distributed along rows and columns, a distance between two adjacent gears of the same row corresponding to a distance between two adjacent gears of the same column.

In some embodiments, the controlling of the gears includes rotating a first gear to steer one of the carriers in a given direction and rotating second and third gears for moving the one of the carriers in the given direction.

In some embodiments, the individually controlling of the gears including powering a first one of the gears to orient the carrier toward one of the at least two distinct paths and powering at least a second one of the gears distinct than the first one of the gears for moving the carrier in the one of the at least two distinct paths.

Many further features and combinations thereof concerning the present improvements will appear to those skilled in the art following a reading of the instant disclosure.

DETAILED DESCRIPTION

Braiding is a process including intertwining at least three yarns in order to create a continuous structure that may be referred to as a braid. A twist may be created using only two yarns. The braid may be produced by moving around carriers on a bedplate. A bedplate may be flat, conical, frustoconical, or cylindrical. A bobbin of yarn is placed on top of each carrier. Paths of the carriers, which may be grooved into the bedplate, intersect each other so as to selectively cause the yarns to intertwine together, hence creating the braid. A pulling mechanism is placed on top of the bedplate in order to pull the yarns and the braided product away from the bedplate.

Figure 1:
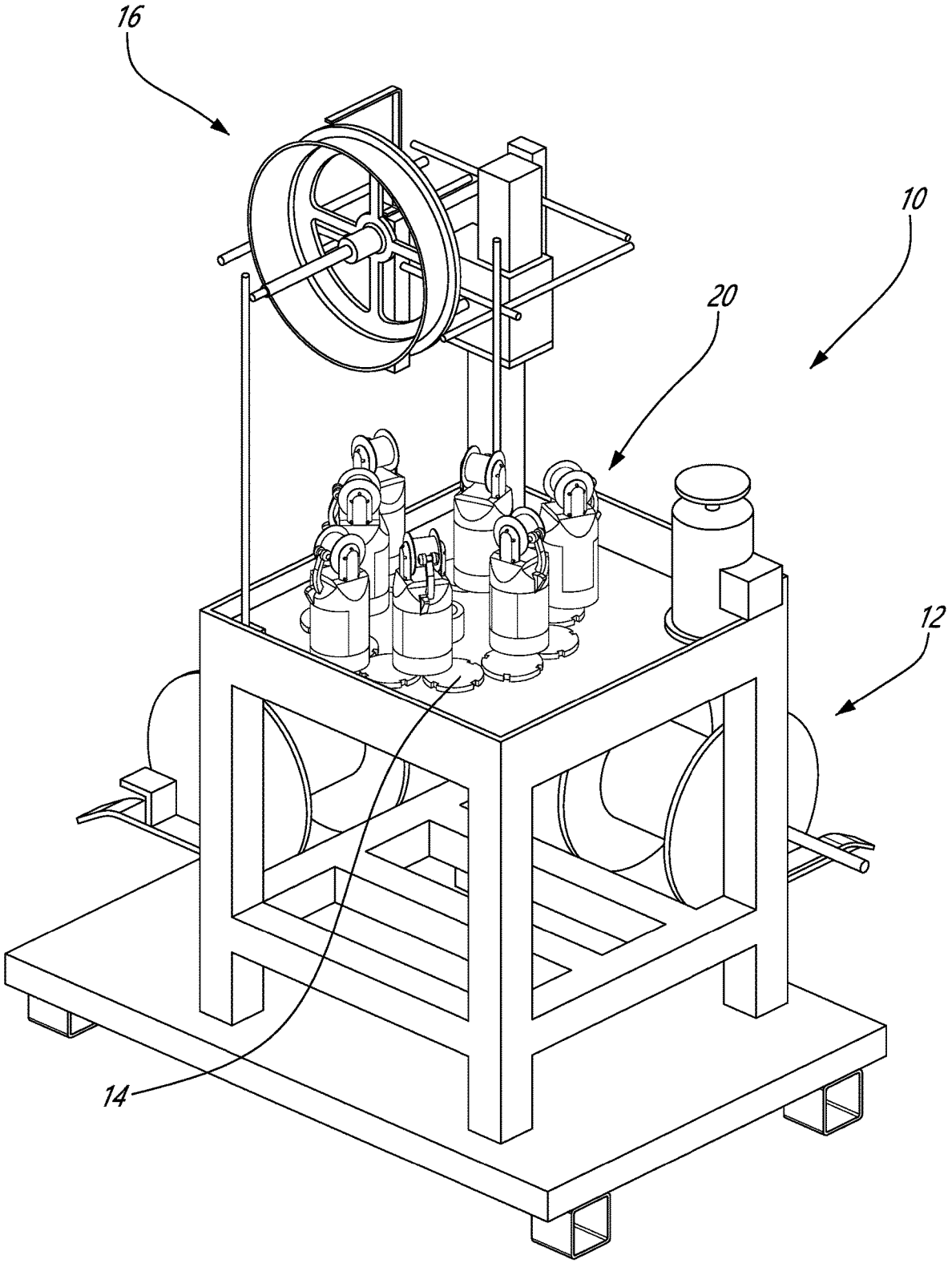
FIG. 1 is a three dimensional view of a braiding machine in accordance with one embodiment.

Referring to FIG. 1, a braiding machine is shown at 10. The braiding machine 10 includes a frame 12 for supporting a plurality of gears 14 that are rotatable about respective axes. In an embodiment, the gears 14 are horn gears. For simplicity, the expression horn gear 14 is used herein, although other types of gears may be used. An overhead structure 16 may be present to exert a pulling action on yarns provided by carriers 20. The braiding machine 10 includes a plurality of the carriers 20, i.e., two or more, that are movable one relative to the others thanks to the gears 14. Each of the carriers 20 carries a one or more bobbin of yarns. The braiding machine 10 creates a braid by relatively moving the carriers 20 with the horn gears 14 thereby intertwining yarns carried by the carriers 20.

The braiding machine 10 may be used to braid yarns of various types, which may include fibers, such as carbon or glass fibers, in a way to meet target geometrical and mechanical performance of a product. The braided fibers may then be impregnated with polymer materials to form a composite material. During braiding, the fibers or yarn are maintained under tension to obtain the target geometry. The carriers 20 disclosed herein may allow to control the tension on the yarn.

Carrier

Figure 2:
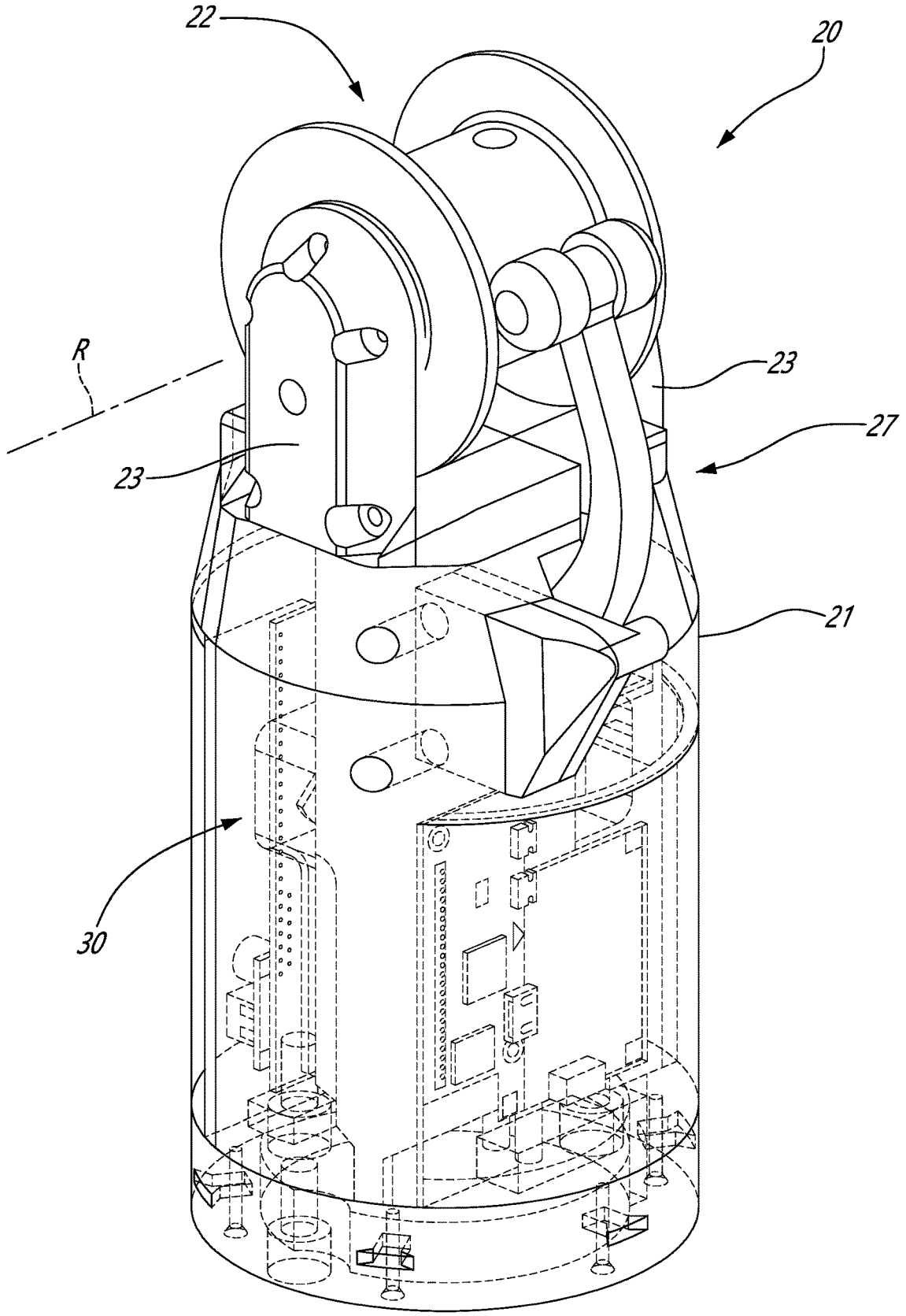
FIG. 2 is a three dimensional partially transparent view of a carrier for the braiding machine of FIG. 1 in accordance with one embodiment.
Figure 3:
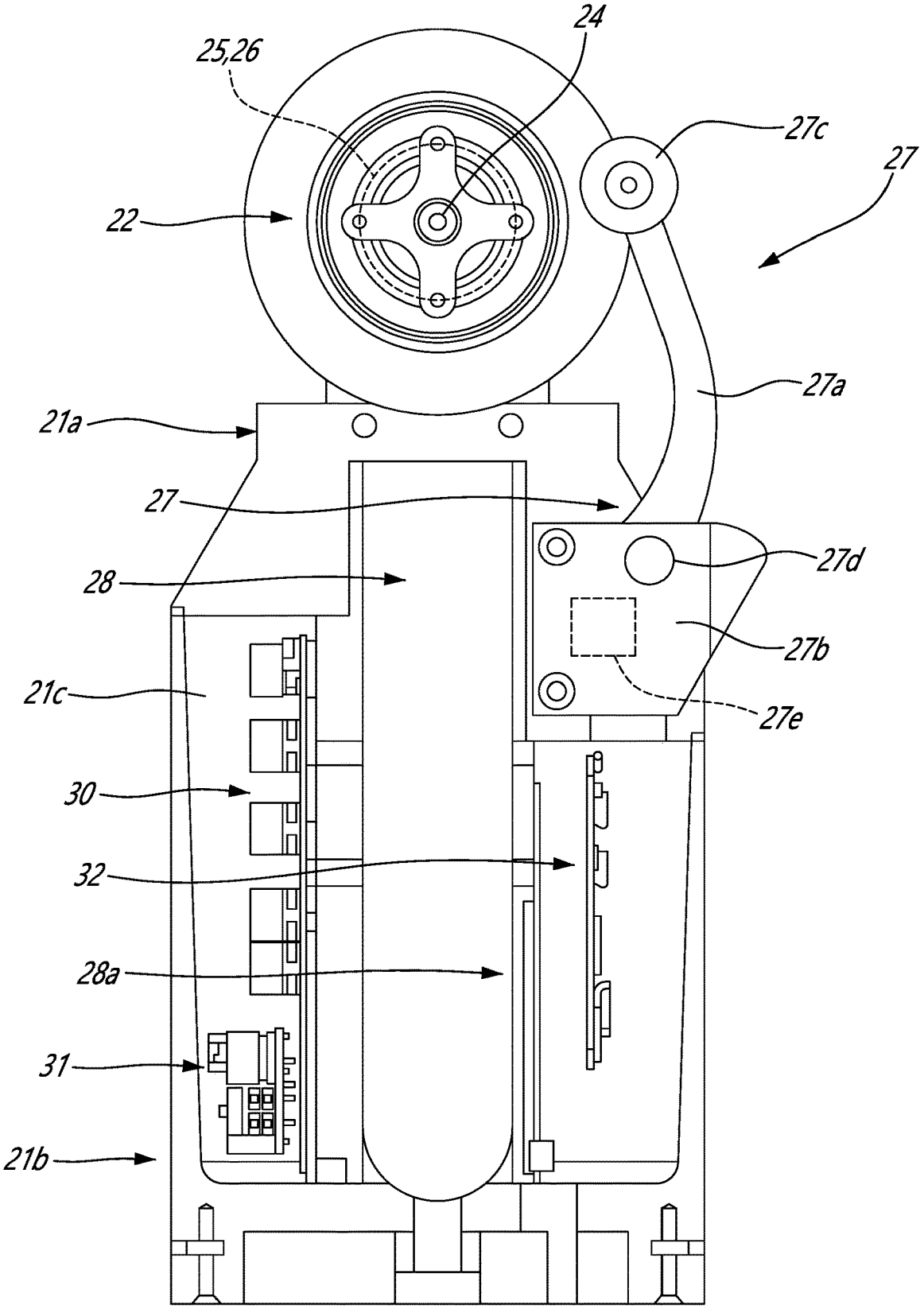
FIG. 3 is a cutaway view of the carrier of FIG. 2.

Referring to FIGS. 2-3, one of the carrier 20 is shown in greater detail. The carrier 20 includes a housing 21 that is engageable by the horn gears 14 of the braiding machine 10. The carrier 20 includes a spool 22 that is rotatably supported by the housing 21 via two arms 23. Particularly, each of the two arms 23 may be cantilevered relative to the housing 21 and supports axial ends of an axle 24 (FIG. 4) that supports the spool 22. An inverted U-shaped structure or a single arm 23 could be used as examples of alternatives to the two arms 23. The carrier 20 includes a motor 25 (FIG. 3) that is disposed concentrically within the spool 22. Therefore, a shaft of the motor 25 may be secured to the two arms 23 and powering of the motor 25 results in a casing of the motor 25 rotating about a rotation axis R with the spool 22, as one possible arrangement. The rotation axis R may be generally horizontal, with a view of having a yarn pulled upwardly, i.e., generally transversely to the rotation axis R. The orientations are relative to one another, and may be changed depending on the orientation of the machine 10.

A control system 30 is located within the housing 21 and will be described herein below with reference to FIG. 4, the control system 30 being for example a PCB, a small processor, etc. The control system 30 is operatively connected to the motor 25 and operatively connected to an encoder 26 that is secured to the spool 22. The encoder 26 is operable to supply data about a position and movement of the spool 22 relative to the arms 23 to the control system 30. The control system 30 is operable to control a tension in the yarn that is wrapped around the spool 22.

The carrier 20 may include a yarn level measuring system 27 that is operatively connected to the control system 30 operable for providing data to the control system 30 about a length of fiber remaining in the spool 22. More particularly, as the yarn is wrapped around the spool 22, the yarn increases an effective diameter of the spool 22. As the yarn gets consumed, this effective diameter decreases until no more yarn is wrapped around the spool 22 and in which the effective diameter of the spool 22 becomes the nominal diameter of the spool 22, that is, the diameter of the spool 22 when it is free of yarn. This change in diameter may affect how a torque generated by motor 25 varies the tension in the yarn. Particularly, for a same torque generated by the motor 25, the tension in the yarn will be greater if the effective diameter is smaller.

In the embodiment shown, the yarn level measuring system 27 includes an arm 27*a* pivotably engaged to the housing 21 via a mount 27*b*, which is secured to the housing 21. Idler wheels 27*c* are rotatably supported at a distal end of the arm 27*a* and used to rollingly engage the yarn. The idler wheels 27*c* maintain a slight pressure against the yarn thanks to a biasing member 27*d*, such as a spring, engaged to the arm 27*a* and to the mount 27*b*. A sensor, herein a potentiometer 27*e*, may be located within the mount 27*b* and may be operatively connected to the arm 27*a*. The potentiometer 27*e* is operatively connected to the control system 30 to supply data to the control system 30 about a level or condition of yarn in the spool 22. For instance, a magnitude of a current going through the potentiometer 27*e* is altered in function of a position of the arm 27*a*.

It will be appreciated that any other suitable sensor operable to indicate a level of yarn into the spool 22 is contemplated. For instance, an optical sensor or an ultrasonic distance sensor may be used.

Referring more particularly to FIG. 3, the housing 21 includes a top portion 21*a* and a bottom portion 21*b* securable to the top portion 21*a*. The housing 21 defines an internal chamber 21*c* that is sized to house the control system 30 and a battery 28 that is operatively connected to the control system 30 and to the motor 25. The battery 28 is centered within the housing 21 since it is the component that determines the size of the housing 21. The housing 21 may be airtight to limit dust from entering the internal chamber 21*c* of the housing 21. A seal may be used to seal gaps between the top and bottom portions 21*a*, 21*b* of the housing 21. The battery 28 is one possible way to power the control system 30, with brush type arrangements being another embodiment.

Figure 4:
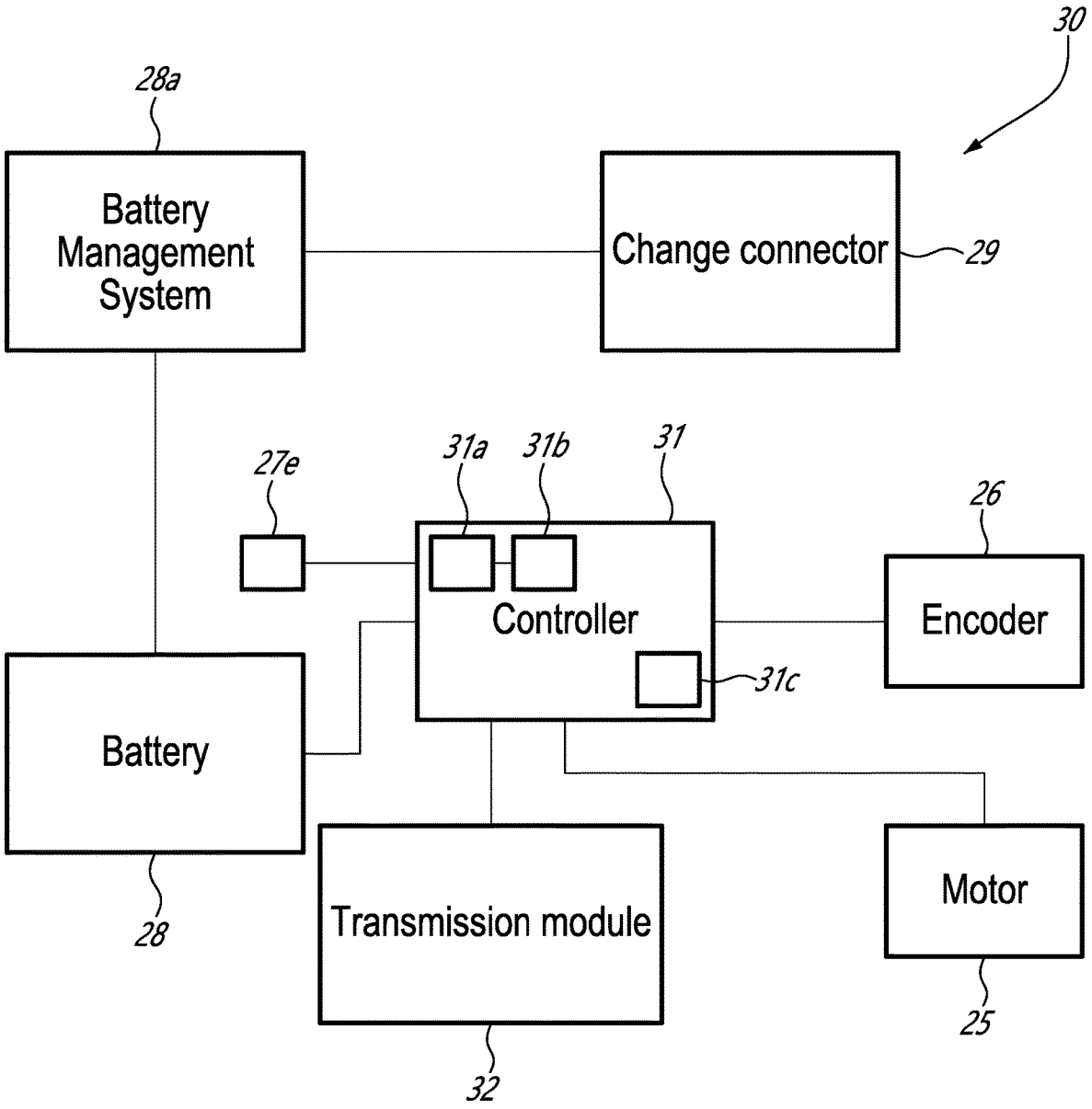
FIG. 4 is a schematic view of a control system of the carrier of FIG. 2.

Referring more particularly to FIG. 4, the control system 30 is illustrated in greater detail. The carrier 20 has a charge connector 29 operatively connected to the battery 28 for charging the battery 28. In the embodiment shown, the battery is a lithium-polymer four-cells battery of 14.8 Volts and having a capacity of 5000 mAh, as an example. This battery 28 may provide the carrier 20 with an 8-hour autonomy. The battery 28 is operatively connected to a battery management system 28*a* used for balancing the different cells of the battery 28 and to protect the battery 28 if it becomes depleted. The charge connector 29 is operatively connected to the battery 28 via the battery management system 28*a*.

The control system 30 includes a controller 31 having a processor 31*a* and a computer-readable medium 31*b* operatively connected to the processor 31*a*, the readable medium 31*b* being for example a non-transitory computer-readable memory communicatively coupled to the processor 31*a* and comprising computer-readable program instructions executable by the processor 31*a*. The controller 31 is operatively connected to the encoder 26, to the motor 25, and to a transmission module 32 that is used to supply data to the carrier 20 and retrieve data 20 from the carrier 20. The transmission module 32 is herein a wireless module. In the embodiment shown, the transmission module 32 is a Raspberry Pi™ zero wireless. All of the controller 31, the transmission module 32, the battery management system 28*a*, the battery 28, the transmission module 32 are contained within the housing 21. The controller 31 may have a voltage regulator 31*c* that is operatively connected to the encoder 26 and to the motor 25. The voltage regulator 31*c* is operable to control a power supplied to the motor 25 to control the tension in the yarn. The controller 31 is further operatively connected to the potentiometer 27*e* to receive data about a level of yarn remaining in the spool 22.

The motor 25 may be a BR2212 BLDC motor. The encoder 26 may be a AMT102-V encoder. The controller 31 may be a BDDrive V1 with an on-board voltage regulator XL6009. Any other suitable components may be used without departing from the scope of the present disclosure. In the depicted embodiment, the housing 21 has a diameter of about 11 cm. The carrier 20 has a height of about 26.5 cm. The controller 31 may be an ODrive Robotics™ circuit.

Figure 5:
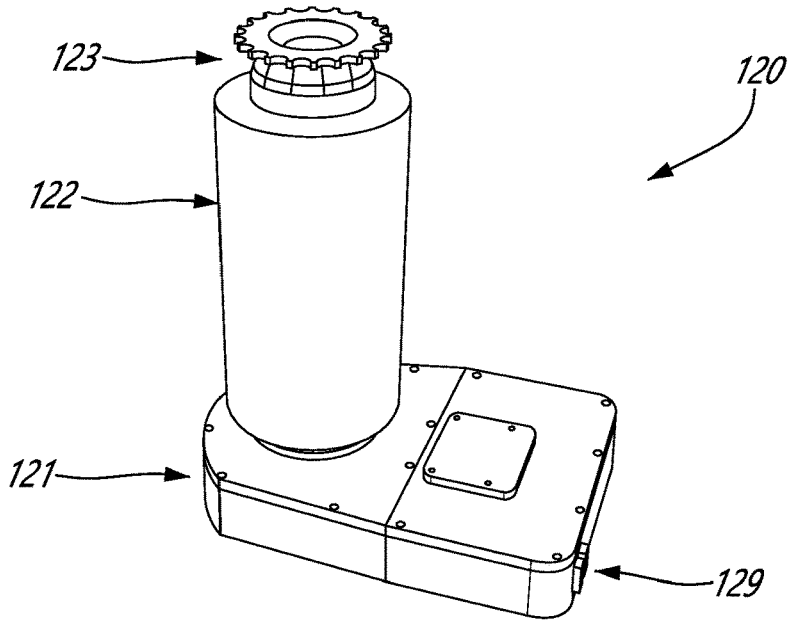
FIG. 5 is a three dimensional view of a carrier in accordance with another embodiment.
Figure 6:
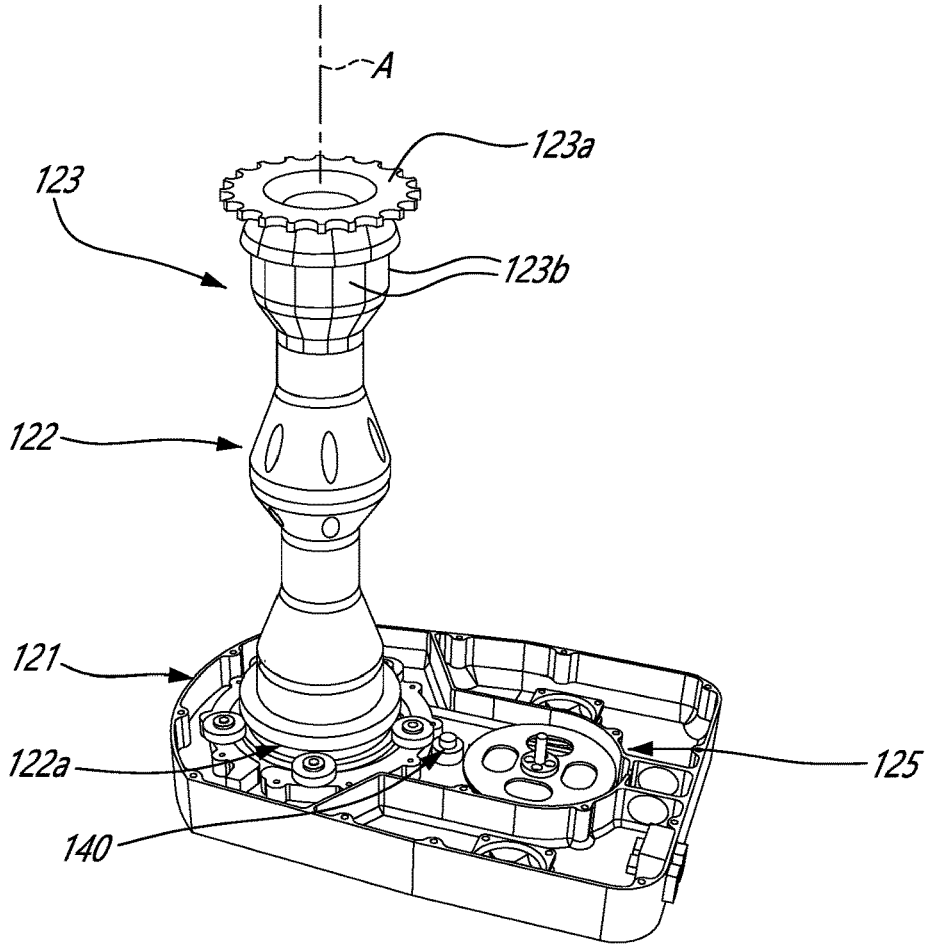
FIG. 6 is another three dimensional view of the carrier of FIG. 5 with parts removed for illustration purposes.

Referring now to FIGS. 5-6, another embodiment of a carrier is shown at 120. This carrier 120 may be used in a process called "pultrusion". Pultrusion is a continuous process in which yarns are unidirectional, woven or braided and impregnated with resin and pulled through a heated stationary die where the resin undergoes polymerization. The impregnation may be done by pulling the yarns through a bath of resin or by injecting the resin into an injection chamber.

In the pultrusion process, the yarns are pulled and the carriers 120 are used to control a rate at which the yarns get unwound from the spool to control the tension in the yarns. The carriers 120 do not need to move one relative to the other as may be the case for the braiding machine 10 of FIG. 1.

The carrier 120 has a housing 121 and a spool 122 rotatably supported by the housing 121. The spool 122 is a rotary axle sized to engage bobbins and a tightening mechanism 123 is used to tighten the bobbins on the spool 122 so that the bobbins and the spool 122 rotate concurrently. In the embodiment shown, the tightening mechanism 123 includes a sprocket wheel 123*a* having a member secured thereto threadingly engaged to the spool 122. The spool 122 defines a plurality of sections 123*b*, which are cantilevered. The sections 123*b* are radially deformable relative to a rotation axis A of the spool 122. Fastening the sprocket wheel 123*a* and its member secured thereto into the spool 122 deforms the sections 123*b* radially outwardly away from the rotation axis A until the sections 123*b* are abutted against and frictionally engaged to the bobbin. The housing 121 is sized to receive the motor 125, the encoder 26, and a control system 130. A connector 129 is secured to the housing 21 and is operatively connected to the control system 130 for powering the carrier 120. The encoder 26 is secured above the motor 125 to obtain the position of the motor 125. The motor 125 may be a MC5206 BLDC motor. The connector 129 may receive an input voltage from 12 to 24 Volts.

Figure 7:
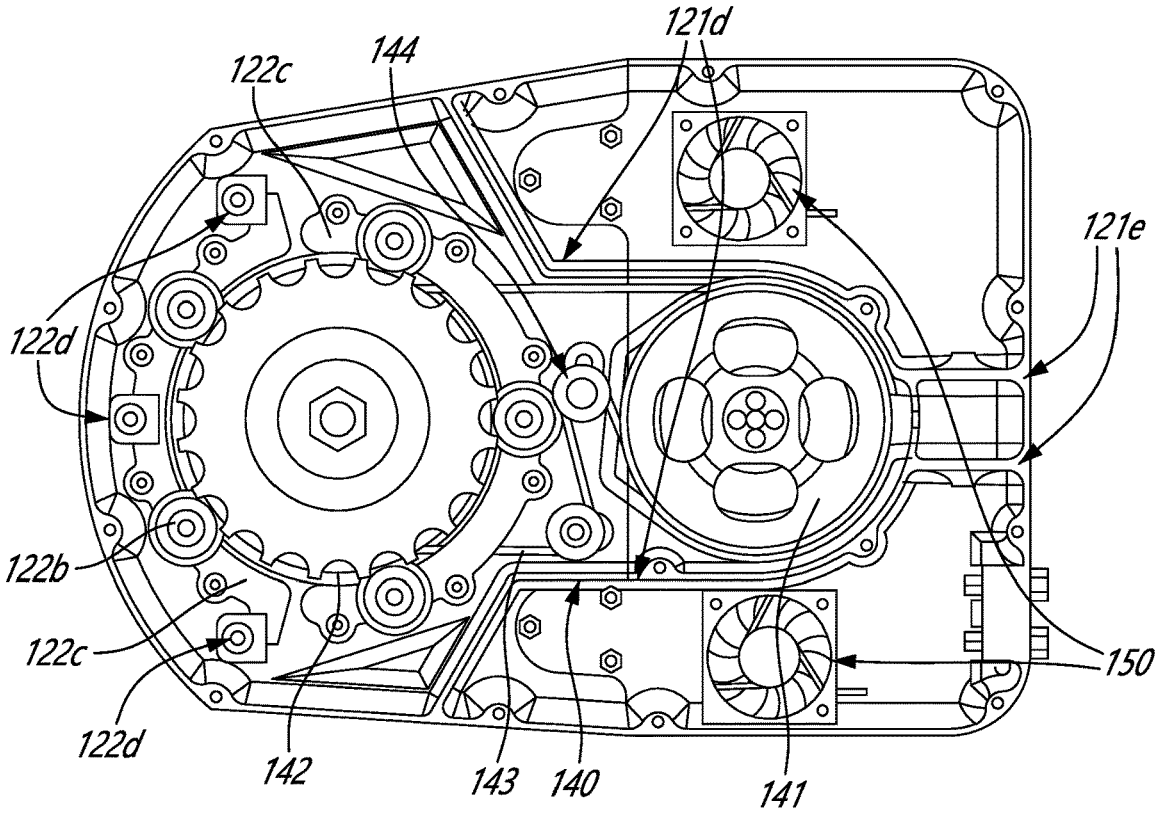
FIG. 7 is a top view of the carrier of FIG. 5 showing internal components thereof.
Figure 8:
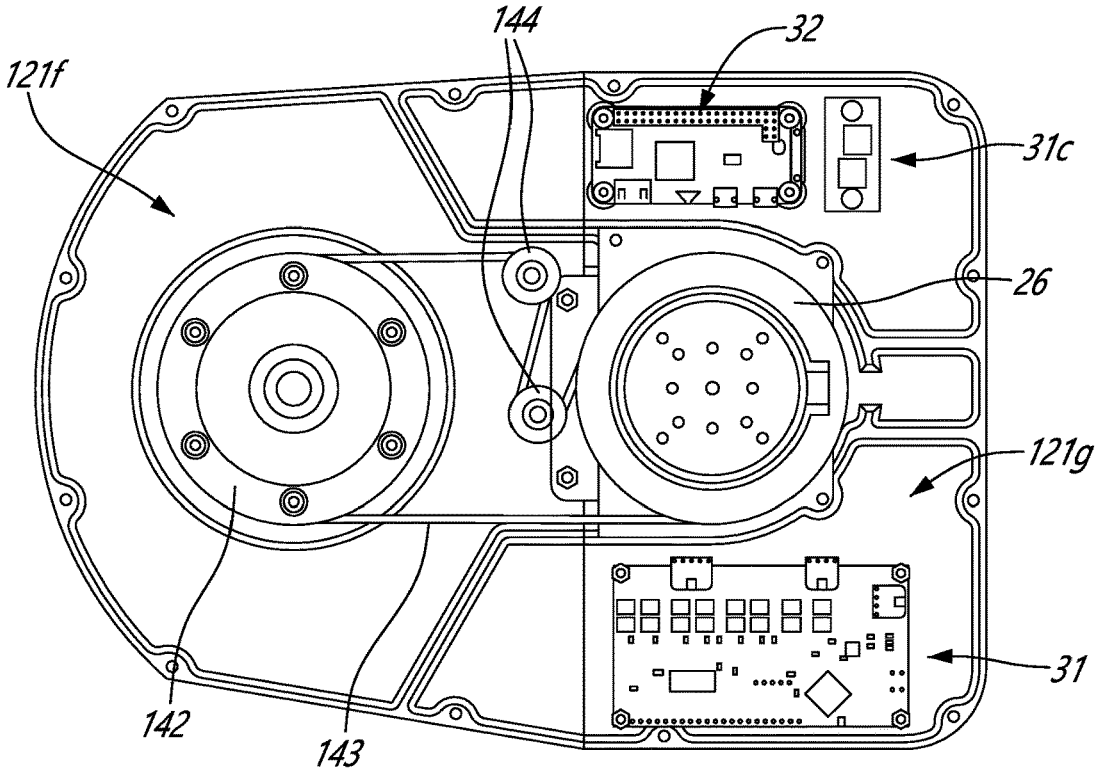
FIG. 8 is another top view of the carrier of FIG. 5 showing other internal components thereof.

Referring to FIGS. 7-8, the motor 125 is in driving engagement with the spool 122 via a transmission 140 including a first pulley 141 drivingly engaged to the motor 125, a second pulley 142 drivingly engaged to the spool 122, and a strap 143 wrapped around the first pulley 141 and the second pulley 142 for transmitting a rotation of the first pulley 141 to the second pulley 142. Idler pulleys 144, two in the present embodiment, are engaged by the strap 143 and are used to maintain appropriate tension in the strap 143. The idler pulleys 144 may be slidingly engaged within grooves defined through a wall of the housing 121 to increase or decrease the tension in the strap 143. The pulleys 141, 142 may be sprockets, and a chain may be used. It will be appreciated that the transmission may be any suitable means able to transmit a rotational input from the motor 125 to the spool 122 without departing from the scope of the present disclosure. For instance, a gearbox may be used.

The housing 121 defines inner walls 121*d* and guides 121*e*. The guides 121*e* are sized for receiving the alimentation cables therebetween. The inner walls 121*d* may extend along an entire height of the housing 121, from a top wall to a bottom wall thereof, and may substantially define a first chamber 121*f* (FIG. 8) enclosing the motor 125 and the transmission 140, and a second chamber 121*g* (FIG. 8) separate from the first chamber 121*f*. The second chamber 121*g* may house the control system 130. Therefore, in the embodiment shown, the electrical components (e.g., controller 31) are substantially isolated from the spool and transmission 140.

As illustrated in FIG. 7, ventilators 150, two in the embodiment shown, are secured to the housing 121 and are operable to create an airflow between the second chamber 121*g* of the housing 121 and an environment outside the housing 121. This airflow may cool the different components of the control system 130 that are located inside the housing 121. These ventilators may have a diameter of about 40 mm. The ventilators 150 are used to increase a pressure inside the housing 121 beyond that of the environment outside the housing 121 to limit dust from penetrating the housing 121.

Referring to FIGS. 6-7, the spool 122 is rollingly engaged to the housing 121. Particularly, the spool 122 is secured to the second pulley 142 for concurrent rotation therewith. The spool defines a groove 122*a* that is rollingly engaged by idler wheels 122*b*, five idler wheels 122*b* being present in this embodiment. The idler wheels 122*b* are rotatably supported by two arcuate members 122*c* that extend around a circumference of the spool 122. The two arcuate members 122*c* are secured to the housing 121. The idler wheels 122*b* are in engagement with the groove 122*a* for guiding a rotation of the spool 122. The idler wheels 122*b* may be V-wheels. Nuts 122*d* are engaged to the housing 121 and to one of the two arcuate members 122*c*. The nuts 122*d* may be removed to remove the one of the two arcuate members 122*c* thereby allowing the spool 122 to be separated from the housing 121 and replaced if need be. The nuts 122*d* are used to maintain a relative position between the two arcuate members 122*c* to maintain the idler wheels 122*b* in rolling contact with the spool 122.

Figure 9:
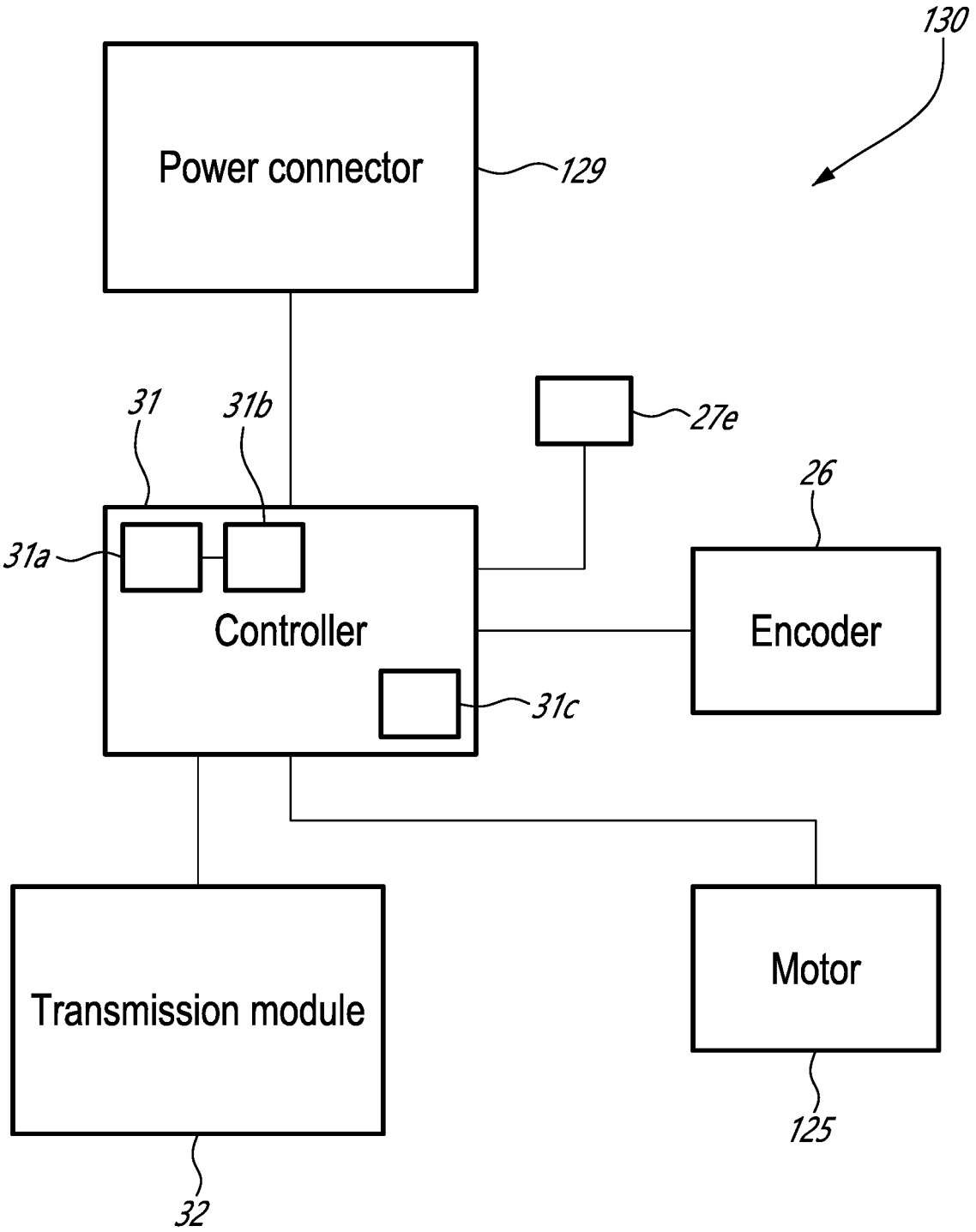
FIG. 9 is a schematic view of a control system for the carrier of FIG. 5.

Referring now to FIG. 9, the control system 130 of the carrier 120 is shown in greater detail. The control system 130 includes the controller 31 having a processor 31*a* and a computer-readable medium 31*b* operatively connected to the processor 31*a*, the readable medium 31*b* being for example a non-transitory computer-readable memory communicatively coupled to the processor 31*a* and comprising computer-readable program instructions executable by the processor 31*a*. The controller 31 is operatively connected to the encoder 26, to the motor 125, and to the transmission module 32 that is used to supply data to the carrier 20 and retrieve data 20 from the carrier 120. The transmission module 32 is herein a wireless module. In the embodiment shown, the transmission module 32 is a Raspberry Pi™ zero wireless. All of the controller 31, the transmission module 32, the battery management system 28*a*, the transmission module 32 are contained within the housing 121. The controller 31 has a voltage regulator 31*c* that is operatively connected to the encoder 26 and to the motor 125. The voltage regulator 31*c* is operable to control a power supplied to the motor 125 to control the tension in the yarn.

The control system 130 is similar to the control system 30 described above with reference to FIG. 4, but lacks the battery and the battery management system. That is, the carrier 120 may be powered via cables connected to the power connector 129. In the pultrusion process, the carriers 120 may not need to move one relative to the other and, consequently, may not need a battery and may be directly connected to a power grid. Although not illustrated in FIGS. 6-7, the carrier 120 also includes the yarn level measuring system 27 described above with reference to FIGS. 2-3. The controller 31 is further operatively connected to the yarn level measuring system 27 as explained herein above. That is, the controller 31 is further operatively connected to the potentiometer 27*e* to receive data about a level of yarn remaining in the spool 22.

Figure 10:
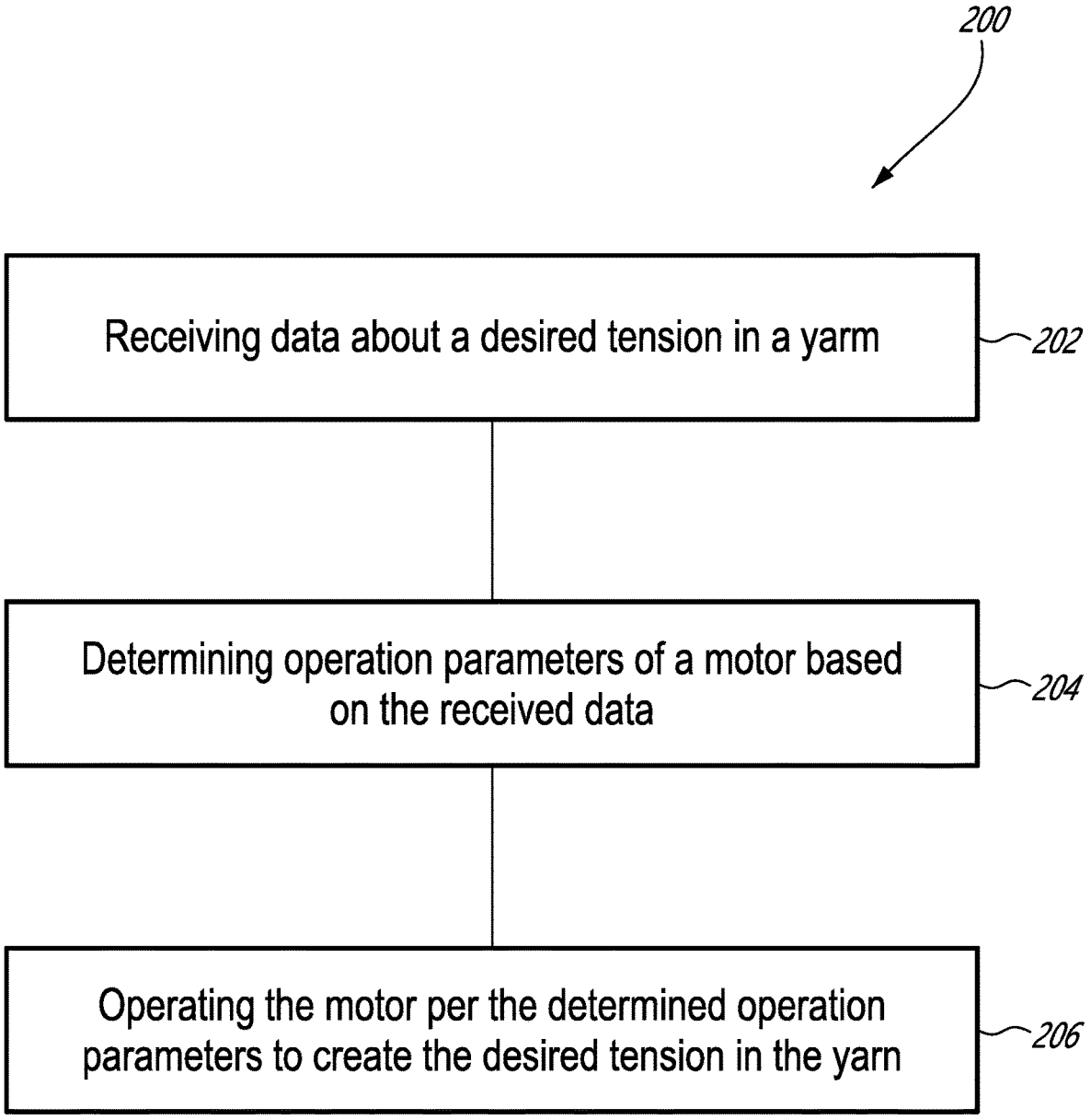
FIG. 10 is a flow chart of an example method for operating the carriers of FIGS. 2 and 5.

Referring to FIG. 10, the controller 31 may comprise any suitable devices configured to implement a method 200 such that instructions, when executed by the controller 31 or other programmable apparatus, may cause the functions/acts/steps performed as part of the method 200 as described in FIG. 10 to be executed. The processing unit 31*a* may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The computer-readable medium 31*b* may comprise any suitable known or other machine-readable storage medium. The computer-readable medium 31*b* may comprise non-transitory computer readable storage medium, for example, but not limited to, an electronic, magnetic, optical, electromagnetic, infrared, or semiconductor system, apparatus, or device, or any suitable combination of the foregoing. The computer-readable medium 31*b* may include a suitable combination of any type of computer memory that is located either internally or externally to device, for example random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. Computer-readable medium 31*b* may comprise any storage means (e.g., devices) suitable for retrievably storing machine-readable instructions executable by processing unit 31*a*.

The method 200 for operating the carrier 20 and/or the carrier 120 described herein may be implemented in a high level procedural or object oriented programming or scripting language, or a combination thereof, to communicate with or assist in the operation of a computer system, for example the controller 31. Alternatively, the method 200 may be implemented in assembly or machine language. The language may be a compiled or interpreted language. Program code for implementing the method 200 may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the method 200 may also be considered to be implemented by way of a non-transitory computer-readable storage medium having a computer program stored thereon. The computer program may comprise computer-readable instructions which cause a computer, or more specifically the processing unit 31*a*, to operate in a specific and predefined manner to perform the functions described herein, for example those described in the method 200.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

The method 200 comprises the steps of receiving data about a desired tension in the yarn 202; determining operation parameters of the motor 25, 125 based on the received data 204; and operating the motor 25, 125 per the determined operation parameters to create the desired tension in the yarn 206.

In the embodiment shown, the receiving of the data includes receiving data about a quantity of yarn remaining around the spool 22, 122. The receiving of the data about the quantity of the yarn may include receiving a signal from a sensor such as the potentiometer 27*e* indicative of the quantity of the yarn remaining. Determining of the operation parameters includes determining a torque generated by the motor 25, 125. The determining of the torque includes determining a current and/or tension to be supplied to the motor 25, 125 to achieve the determined torque. The receiving of the data includes receiving data about an angular position of the motor. The angular position may be supplied by the encoder 26.

The control system 30, 130 is configured to control an input current supplied to the motor 25, 125 to control the torque generated by the motor 25, 125. Based on the quantity of yarn remaining on the spool 22, 122, which is provided by the yarn level measuring system 27, the controller 31 is able to calculate the tension exerted on the yarn.

The controller 31 may be able to store a database to operate the carrier 20, 120. The controller 31 may be able to supply data that is visualized by a user in real time. This data may include, for instance, current to the motor, tension of the power supplied to the motor, the amount of yarn remaining in the spool 22, 122, tension in the yarns, and so on. Each of the communication module 32 of each of the carriers 20, 120 of the braiding machine 10 or pultrusion machine may communicate with a central controller operable by a user, who can visualize the data and control operation of the processes. That is, a user may wirelessly send control commands to the carriers 20, 120 in real time. The user may control the tension wirelessly in real time via the communication module 32.

In a particular embodiment, the carriers 20, 120 allow the programming on-demand of each of the carriers of the braiding machine 10 individually (FIG. 1). The tension in the yarns may be modified without any modification to the carriers. The tension may be adjusted in real time during the braiding process. This may allow the creation of a braid of complex and variable geometry. Moreover, the carriers 20, 120 may rewind the yarn on the spool 22 when the yarn is not under sufficient tension. This may allow braiding in three dimensional geometries. The disclosed carriers 20, 120 may allow real-time data to be obtained thanks to the bi-directional communication between a control center and each of the carriers. This may allow the building of a database from the plurality of carriers 20, 120. This database may be loaded on the braiding machine 10 for braiding composite yarns. The database may allow a control of each manufacturing step of the composite yarn. Any abnormality may be detect as soon as it appears. This may allow a reduction of operation costs. The carriers 20, 120 may rewind some of the yarns of a braid to change its structure and its geometry during the braiding process. The braiding machine 10 may be used, for instance, to manufacture composite yarns that may go into fabricating aircraft fuselage, pressurized reservoir, variable geometry beams, sticks, turbine blades, landing gears, and so on.

Braiding Machine

Figure 11:
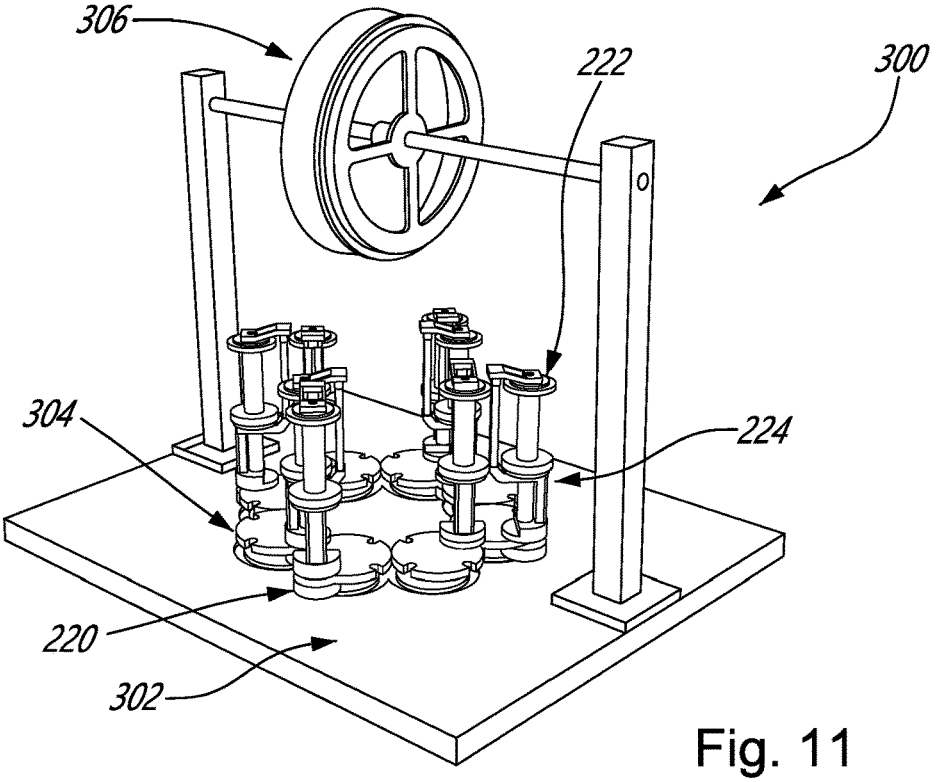
FIG. 11 is a three dimensional view of a braiding machine in accordance with another embodiment.

Referring to FIG. 11, a braiding machine in accordance with one embodiment is shown at 300. The braiding machine 300 includes a bedplate 302, i.e., a table or like supporting structure, supporting a plurality of horn gears 304. A plurality of carriers 220 are engaged by the gears 304, such as horn gears, to move the carriers 220 along a predefined path defined by a track 320*a* (FIG. 12) of the bed plate 302. The carriers 220 include spools 222 and tensioner 224 for creating a tension in the yarns wrapped around the spools 222 while it is being pulled by a pulling mechanism 306 of the braiding machine 300. The carriers 220 may be for example the carriers 20 described herein.

Figure 12:
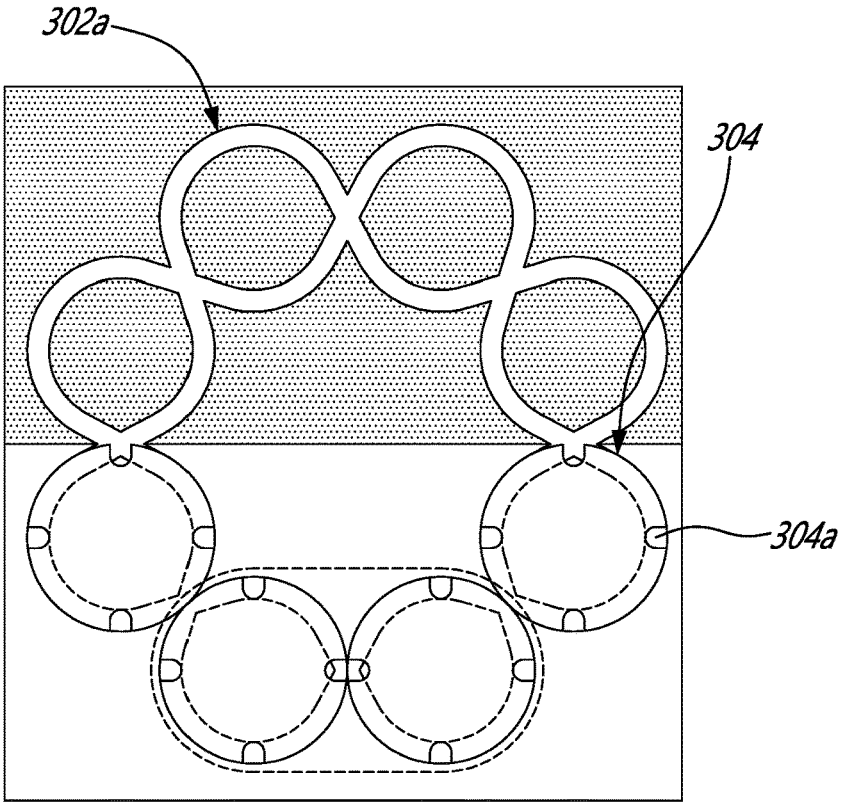
FIG. 12 is a top view of a bed plate and horn gears arrangement of the braiding machine of FIG. 11.

Referring more particularly to FIG. 12, the horn gears 304 are discs with a number of evenly spaced notches 304*a* around their circumferences. These notches 304*a* contain the carriers 220 during their movement. That is, each of the carriers 220 has a shaft engageable within the notches 304*a* of the horn gears 304. The horn gears 304 are placed on the bedplate 302 according to a grooved path. Each horn gear 304 rotates in the opposite side of its neighbours. When two notches 304*a* of two adjacent horn gears 304 are in register with one another, the carrier 220 is transferred from one horn gear 304 to a neighbouring horn gear 304. The carriers 220 therefore follow the track 302*a* by being passed from one horn gear 304 to the next.

The braiding architecture in a textile fabric has a great impact on its mechanical properties. The position of each intertwined yarn, dictated by the speed and trajectory of the carriers, defines the braid geometry. With the horn gear system depicted in FIG. 12, the path followed by the carrier is fixed and cannot be altered. This fix trajectory limits the braid to a fixed shape with a constant braiding pattern. In order to create a complex preform with a continuous variable shape, carriers' trajectory needs to be modifiable. In this case, greater mechanical properties could be reached and the position of each intertwined yarn could be controlled at any time during the braiding process.

Figure 13:
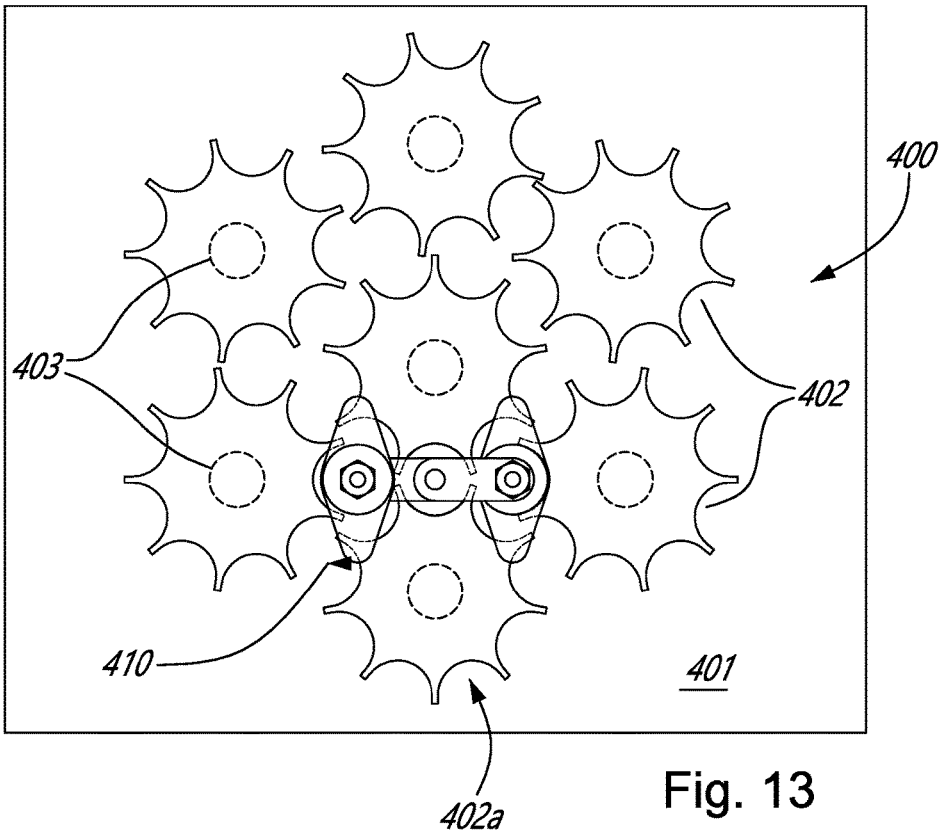
FIG. 13 is a top schematic view of a matrix of gears for a braiding machine in accordance with another embodiment.

Referring now to FIG. 13, a braiding machine has a matrix 400 of gears 402, with adjacent pairs of the gears 402 being evenly spaced apart from one another, the gears 402 being rotatable about their respective rotation axes, but in either direction, i.e., clockwise and counter clockwise. The matrix of gears may be flat, conical, cylindrical. All of the gears 402 are secured to a support structure 401 and are substantially coplanar. The rotation axes of the gears 402 are normal to a plane defined by the support structure 401. Each of the gears 402 may be engaged by a respective bi-directional motor 403 to be individually rotated in a clockwise direction or a counter clockwise direction. The motors 403 may be servo actuator such as Dynamixel™, AX-12a actuators. Such an actuator may provide a high torque while having a compact frame. This actuator has an internal closed loop control system that may allow a higher accuracy for speed, position, and torque commands. All of the motors 403 are operatively connected to a controller, which may be a ArbotiX-M Robocontroller™ board.

Figure 14:
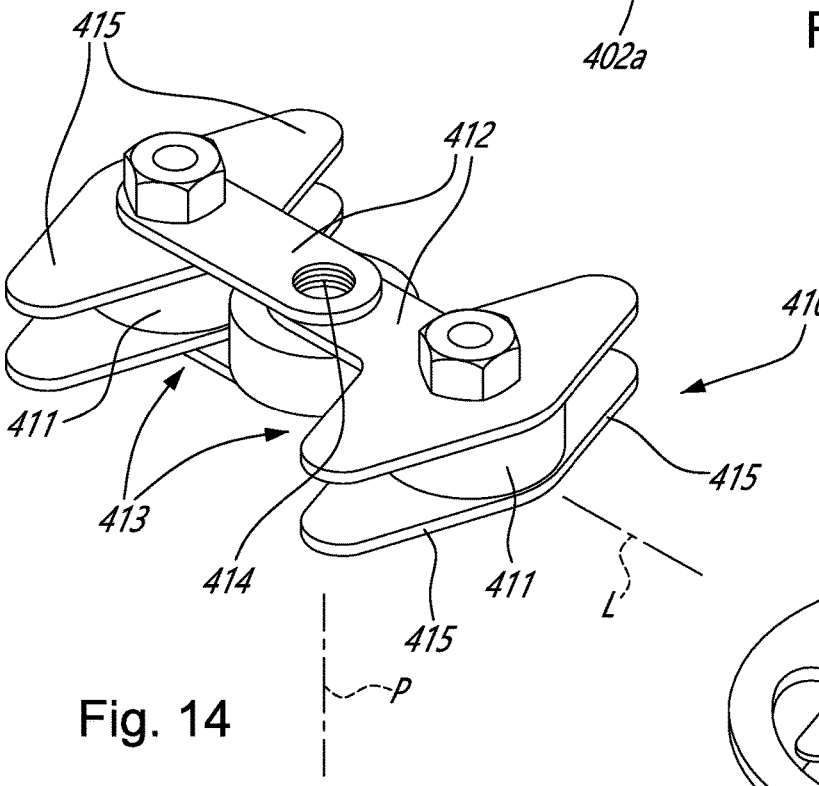
FIG. 14 is a three dimensional view of a chain to be engaged by the matrix of gears of FIG. 13 in accordance with one embodiment.

Referring to FIGS. 13-14, a chain 410 (a.k.a., a link, a chain link) is engageable by the gears 402 and movable by the gears 402 along a path. The path may be selected by controlling the direction of rotation of the different gears 402 and is not a fixed path contrary to the horn gear configuration described above with reference to FIG. 12.

The chain 410 includes three or more rollers 411, also referred to as cylindrical shafts, disposed longitudinally about a longitudinal axis L of the chain 410. The rollers 411 are connected to one another via arms or links 412. In the embodiment shown, the chain 410 of three rollers 411 defines a pivot axis P allowing the chain 410 to change shape. That is, the chain 410 has two or more sections 413 connected to one another at a pivot point 414 and pivotable one relative to the other about the pivot axis P defined by the pivot point 414. The pivot axis P is normal to the plane of the support structure 401. It will be appreciated that the chain may include more than three rollers and define more than two sections. For a chain of "n" rollers, the chain has "n−1" sections and "n−2" pivot points. For instance, a 4-roller chain has three sections connected to one another via two pivot points. The rollers 411 have a cylindrical shape in order to fit in notches 402*a* of the gears 402. The rollers 411 may be rotatable about respective roller central axes.

Figure 15:
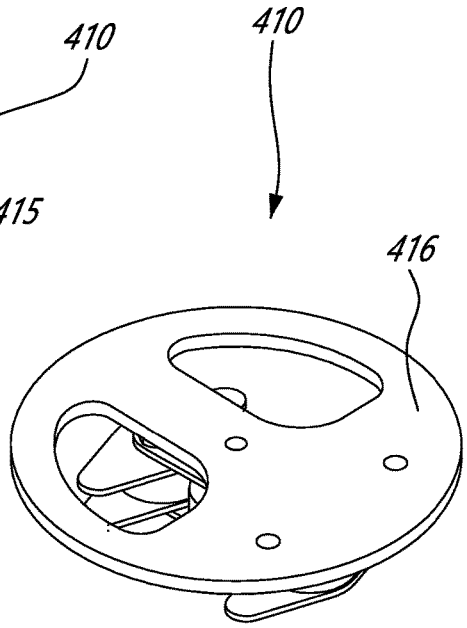
FIG. 15 is a three dimensional view of the chain of FIG. 14 shown with a support plate in accordance with one embodiment for supporting a carrier.

Opposed ends of the chain 410 define flanges 415 that protrude away from the longitudinal axis L. These flanges 415 may provide stability to the carriers 20, 120, 220 when the carriers 20, 120, 220 are moving, or ensure that the chains 410 are constrained to a planar movement in a plane of the support structure 401. In the embodiment shown, some of the flanges 415 are defined by the links 412. Some other of the flanges 415 are defined by separate parts secured to the chain 410. FIG. 15 illustrates a plate 416 that may be used as an interface to connect the carriers 20, 120, 220 to the chain 410. As illustrated, a footprint of the bottom plate 220*a* is greater than that of the chain 410. Moreover, a center of the carriers 220 may be in register with the pivot point P of the chain 410.

It will be appreciated that a braiding machine may include any of the carriers 20, 120 described herein above with reference to FIGS. 2 and 5 with the matrix 400 and chain 410 system described herein.

Figure 16:
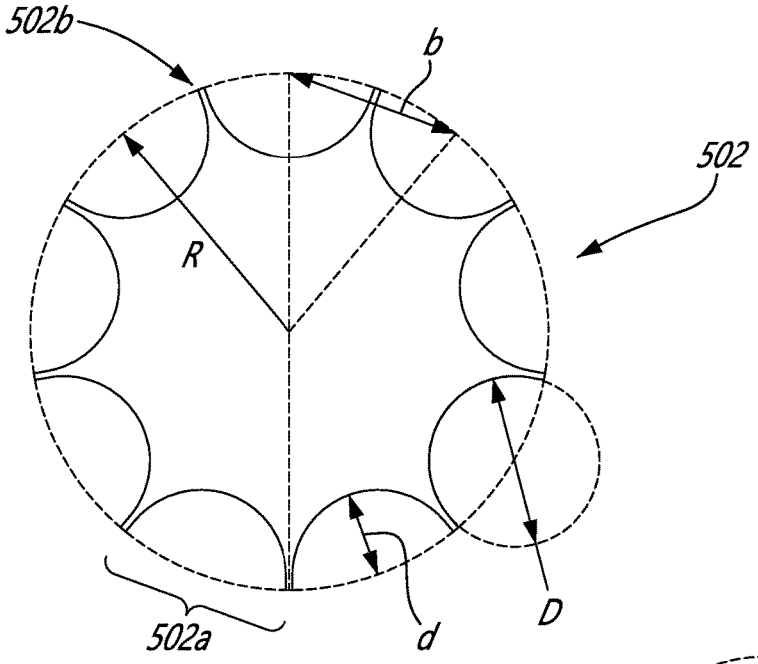
FIG. 16 is a top schematic view of a gear in accordance with one embodiment.
Figure 17:
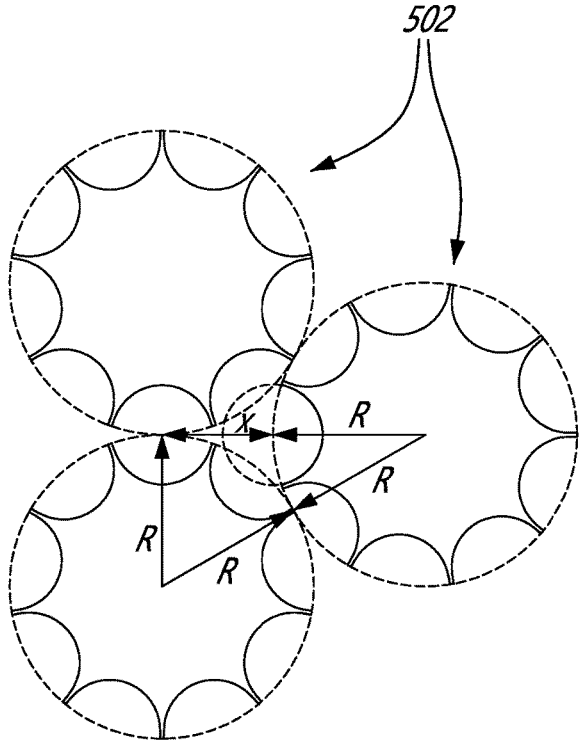
FIG. 17 is a top schematic view of three of the gears of FIG. 16 in an exemplary matrix.
Figure 18:
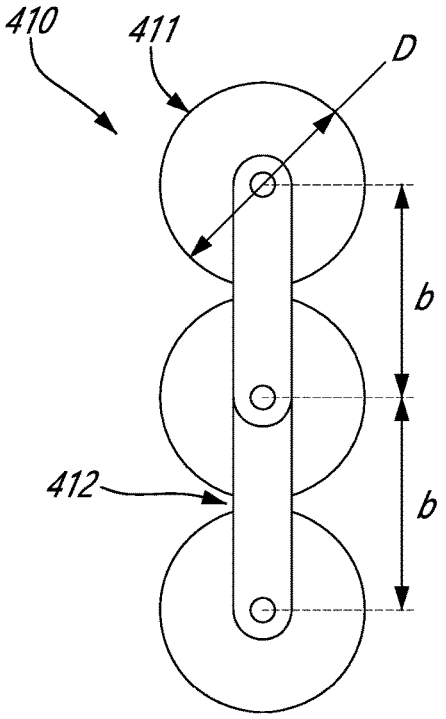
FIG. 18 is a top schematic view of the chain of FIG. 14.

Referring to FIGS. 16-18, another embodiment of a gear is shown at 502. The gear 502 includes nine equidistantly spaced notches 502*a*. The gear 502 has a radius R and the notches 502*a* are spaced apart from one another by a distance b. In the embodiment shown, free ends of teeth 502*b* are contained within a circle having the radius R. The distance b between two adjacent notches is a straight line between centers of the two notches 502*a*. The distance b also corresponds to the distance between centers of two adjacent rollers 411. The notches 502*a* have a diameter D that is herein generally equal to or slightly larger than a diameter of the rollers 411 shown schematically in FIG. 18. A center of the diameter D of the notches 502*a* is at a point of a tangent to a circumference of the gear 502 as shown with dashed lines in FIG. 16. As illustrated in FIG. 18, a length of the link 412 substantially corresponds to the spacing b between two adjacent notches 502*a*. As shown in FIG. 16, a depth d of the notches 502*a* generally corresponds to or is slightly large than a radius of the rollers 411, which is half the diameter D.

Referring to FIG. 17, an hexagonal compact arrangement of three gears 502 is shown. The gears 502 are in close contact. The dimension x is the free length between the circumference of the gear 502 and a contact point between two adjacent gears 502. A diameter of the rollers 411 is selected to limit mechanical blockage. In some embodiments, D is close to b while letting the teeth 502*b* of the gears 502 to extend to the circumference of the gears 502.

The dimension x may be calculated as follows:

$$x=(\sqrt{3}-1)R$$

Whereas the dimension b is calculated as follows:

$$b = 2R\sin\left(\frac{\pi}{N}\right)$$

Where N is the number of notches 502*a* of the gear 502.

The number of notches is selected as to prevent the chain 410 from buckling. This may imply that b is less than x. If b is greater than x, the chain 410 might cause a mechanical blockage when transitioning from a gear 502 to the adjacent gears 502. Moreover, to facilitate the engagement of the chain 410 in the adjacent gears 502, which is responsible for steering, b is close to x.

To determine the number of notches N, the following equations are resolved:

$$b < x$$

$$2R\sin\left(\frac{\pi}{N}\right) < \frac{\sqrt{12}-2}{2}R$$

This yields:

$$N > \frac{\pi}{\sin^{-1}\left(\frac{\sqrt{3}-1}{2}\right)}$$

This means that N is greater than 8.3835. This design equation fixes the number of notches for the hexagonal compact arrangement of gears to 9. In the embodiment shown, the gears have a gear radius R of 33.25 mm. The dimension x is 24.3 mm. Each notch 502*a* and chain rollers 411, have a diameter of D of 21.92 mm.

Referring now to FIGS. 19*a* to 19*f*, a movement of a chain 410 relative to a portion of the matrix 400 of FIG. 13 is illustrated. Only a portion of the matrix 400 is illustrated. Each of the gears 402 has nine notches 402*a* as established per the calculations above.

In order to move the chain 410 around the support structure 401, the gears 402 cooperate to orient the chain 410. As shown in FIG. 19*b*, a bottom one of the gears 402 rotates clockwise and orient the chain 410 toward the right. The upper and left gears 402 rotate respectively in counter clockwise and clockwise direction to push the chain 410 along the direction imparted by the bottom gear 402 as shown in FIG. 19*c*. Further rotation as illustrated in FIG. 19*d* results in a leading roller of the chain 410 to be received in a notch 402*a* of the right gear 402 as shown in FIG. 19*e*. At that point, the chain 410 can go left and downwards by rotating the left gear in a clockwise direction and by soliciting the cooperation of the other gears 402.

Figure 19A:
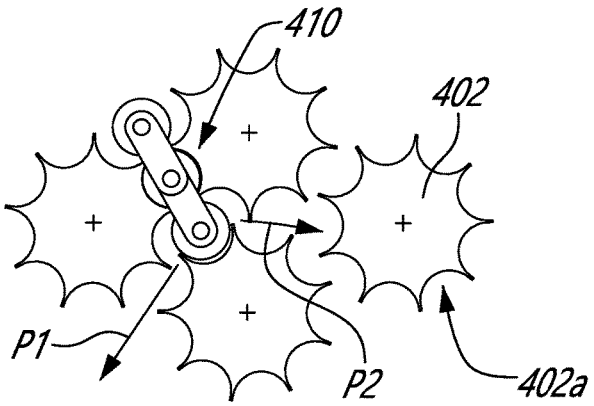
FIGS. 19*a* to 19*f* illustrate a sequence of movements of a matrix of four gears to move the chain of FIG. 14.
Figure 19B:
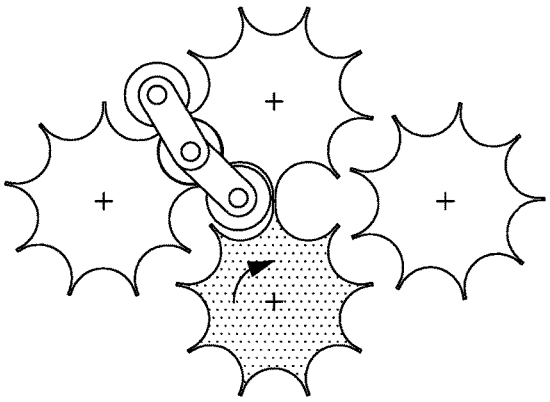
Figure 19C:
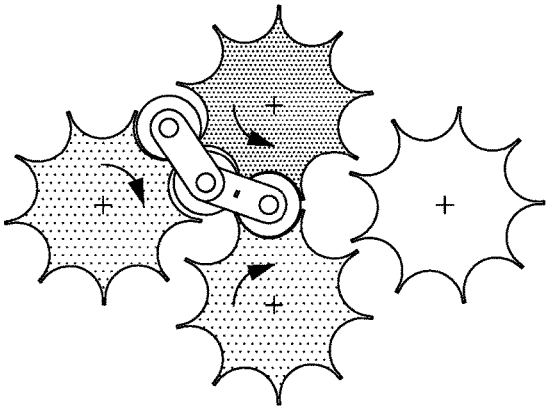
Figure 19D:
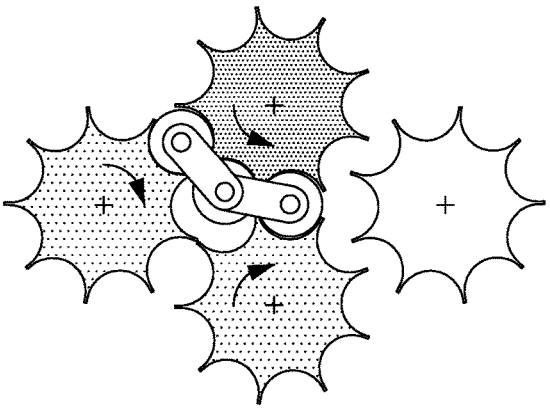
Figure 19E:
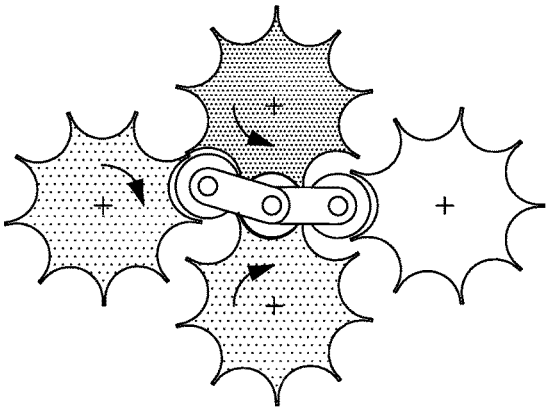
Figure 19F:
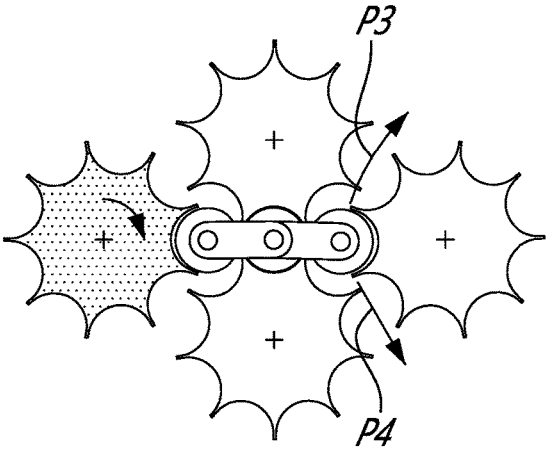

As shown in FIG. 19*a*, the chain 410 is located between the top and left gears and reaches an intersection between two possible paths P1, P2. Each of the paths is defined by two adjacent gears. A shown in FIG. 19*b*, the bottom gear 410 is powered in a clockwise direction to orient the chain 410 toward the second path P2. The bottom gear therefore acts as a steering gear. As shown in FIGS. 19*c* to 19*e*, the top, bottom, and left gears 410 are powered to move the chain 410 in the second path P2. As shown in FIG. 19*f*, the chain 410 reaches another intersection between two paths P3 and P4. The right gear now becomes the steering gear and may rotate in a clockwise direction to orient the chain in the path P3 or in the counter clockwise direction to orient the chain toward the path P4. The left, top, and bottom gears are then powered to move the chain in either one of the two paths P3, P4.

In the depicted embodiment, at least some of the gears of the matrix arranged to form a path between a pair of adjacent ones of the gears to lead to two distinct paths P1, P2 with other adjacent ones of the gears, each of the two distinct paths defined by two of the gears, the two of the gears including one of the pair of the adjacent ones of the gears and another gear.

In the embodiment shown, the cycle of displacement can be divided into two sequential steps: a 10-degree rotation of the gear responsible to steer the chain 410 in a particular direction; and a 60-degree rotation of the three adjacent gears 402 allowing to move the 402 in the direction selected by the steering gear 402. Therefore, the gears 402 perform two roles: moving the chain 410; and steering the chain 410. This dual role of the gears 402 is such that no other mechanism, such as a switch, a guiding foot, or a transfer mechanical system, is required to steer and move the chain 410, and the carrier 20, 120, 220 secured thereto on the support structure 401. The gears 402 are rotated in accordance with a determined sequence. In the embodiment shown, a gear 402 can only house one roller 411 at a time. This may allow a completely independent carrier movement and the carrier may move around the support structure 401 by successively operating sets of three gears 402.

Referring to FIGS. 20*a* to 20*l*, different steps to create a standard flat braid are illustrated. Three chains 410 and three carriers 220 secured thereto are used to create this braid. For simplicity, the gears 402 are depicted as hexagons in those figures, though the gears 40 may be horn gears as those described above. In FIGS. 20*a* to 20*k*, the movements of each of the three chains 410 are depicted with arrows to show the steps required to create the braid.

Figure 20A:
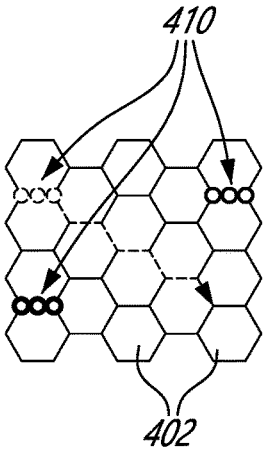
FIGS. 20*a* to 20*l* illustrate a sequence of movements of three chains moving on a matrix of gears to create a flat braid.
Figure 20B:
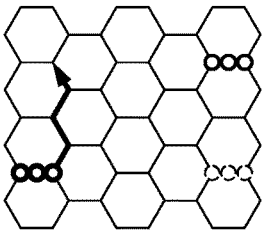
Figure 20C:
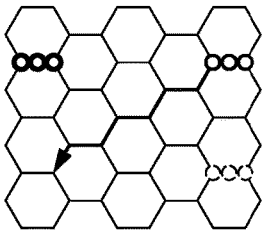
Figure 20D:
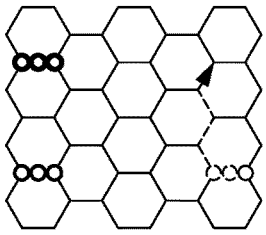
Figure 20E:
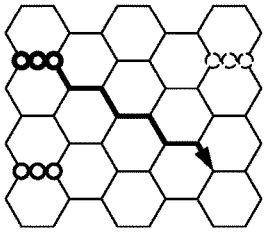
Figure 20F:
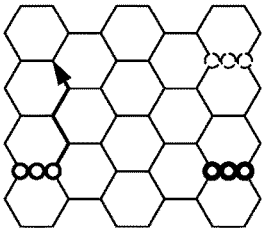
Figure 20G:
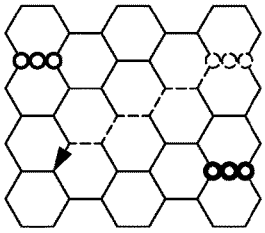
Figure 20H:
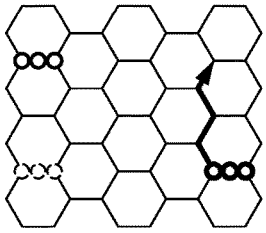
Figure 20I:
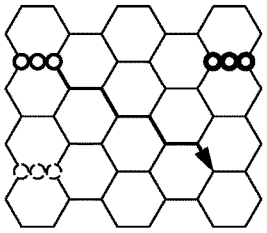
Figure 20J:
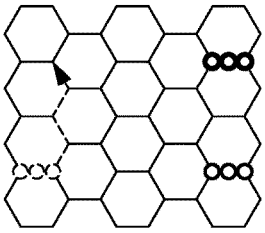
Figure 20K:
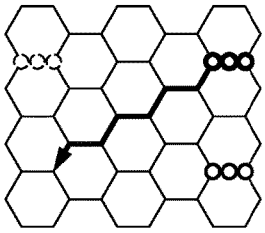
Figure 20L:
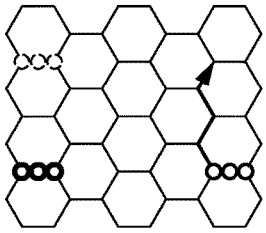

In FIG. 20*a*, a first chain 410 is moved south-east. In FIG. 20*b*, a second chain 410 is moved north. In FIG. 20*c*, a third chain 410 is moved south west. In FIG. 20*d*, the first chain 410 is moved north. In FIG. 20*e*, the second chain 410 is moved south east. In FIG. 20*f*, the third chain 410 is moved north. In FIG. 20*g*, the first chain 410 is moved south west. In FIG. 20*h*, the second chain 410 is moved north. In FIG. 20*i*, the third chain is moved south east. In FIG. 20*j*, the first chain 410 is moved north. In FIG. 20*k*, the second chain 410 is moved south west. In FIG. 20*l*, the third chain is moved north. This process is repeated until the braid has the desired length.

Using the disclosed gears 402 and chains 410, a cross-section of the braid may be varied along its length. This may be done by having one of the chains 410, and carrier 220 secured thereto, set aside thereby winding only two yarns of the remaining carriers 220. The chain 410 that was set aside can, after the two yarns have been wound around one another, rejoin them to continue the normal braiding process. With reference to FIG. 20, to do the winding of the two yarns, two of the chains 410 and carriers 220 have to move simultaneously about a circular path while the third chain 410 is set aside on the side of the support structure 401 and remains immobile.

Consequently, by individually controlling any number of chains 410 by individual control of the motors moving the gears 402, complex geometries of structure may be created. This is enabled by allowing a plurality of possible paths for each of the chains 410. Each of the chains 410 and carriers 20, 120, 220 supported thereto is movable independently from the others. One or more of the chains/carriers may be parked on the side to punctually change the geometry of the braided structure and may re-integrate at any moment to resume the nominal geometry of the braided structure.

The disclosed system may allow to create braid with many thicknesses all connected to one another, within a single fabrication cycle. This is not possible using the horn gear system of FIG. 12. The disclosed system may allow braiding many different structures such has layers interconnected or non-interconnected, yarn winding, braid, unidirectional yarn, within a same braid. Moreover, the disclosed system may allow controlling the position of each yarn crossing. Mechanical properties of the braid may therefore be optimized. It may be possible to produce a braid by decreasing the amount of yarn required while still meeting the desired mechanical properties.

Figure 21:
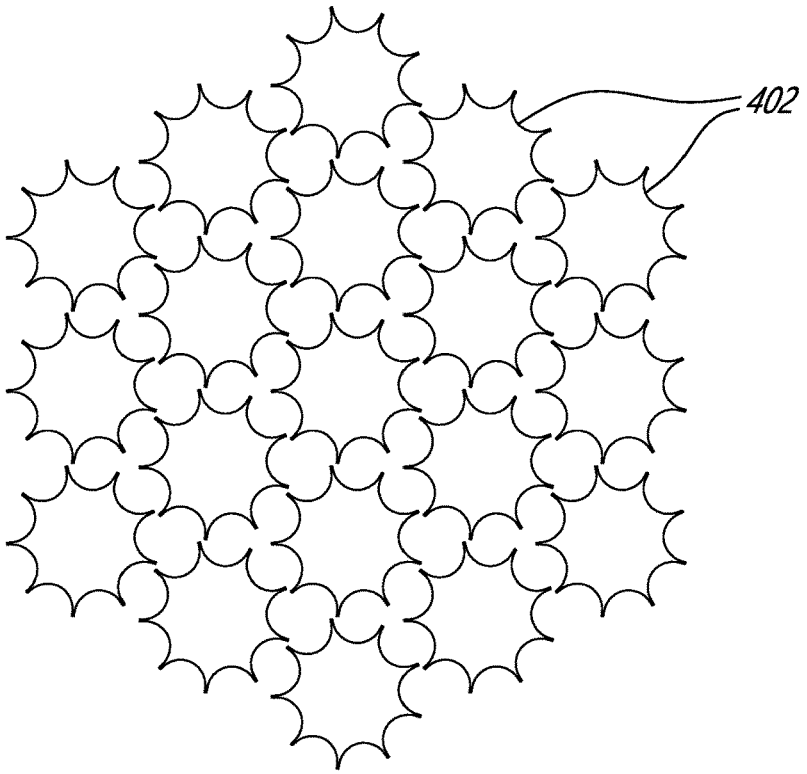
FIG. 21 is a top view of a matrix of gears disposed in an hexagonal arrangement in accordance with one embodiment, each of the gears having nine notches.

Referring to FIG. 21, a matrix of gears 402 in accordance with another embodiment is shown. The gears 402 are disposed in an hexagonal arrangement. As shown, the gears 402, in this arrangement, are equidistantly spaced apart from one another. In this embodiment, the chain moved by a pair of gears 402 may be directed in two different directions. In this arrangement, a gear 402 may have six neighbours. In this embodiment, the chain may be directed in six different directions. The matrix of gears 402 of FIG. 21 may be viewed as a sample of a matrix of many other gears.

Figure 22:
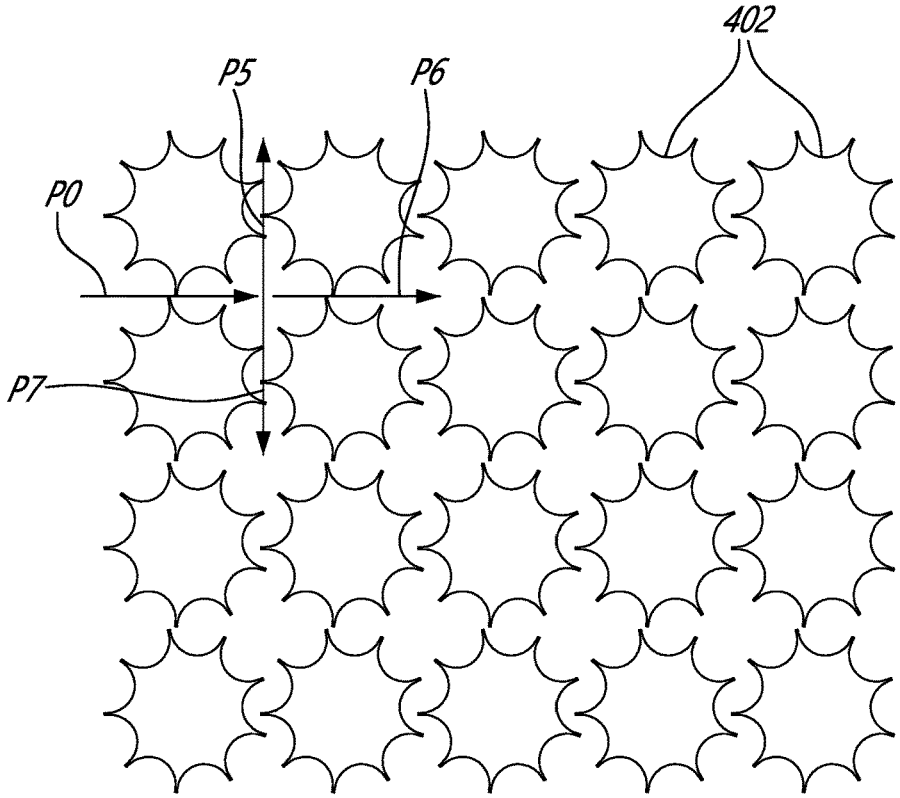
FIG. 22 is a top view of a matrix of gears disposed in a square arrangement in accordance with one embodiment, each of the gears having nine notches.

Referring to FIG. 22, a matrix of gears 402 in accordance with yet another embodiment is shown. The gars 402 are disposed in a row-and-column arrangement. The distance between two gears 402 that are above one another is different than the distance between two gears 402 located on a diagonal. In this embodiment, the chain moved by a pair of gears 402 may be directed in three different directions. A gear 402, in this matrix, may have up to eight neighbours. Again, the matrix of gears 402 of FIG. 22 may be viewed as a sample of a matrix of many other gears.

In this matrix of gears, the chain 410 may be directed toward one of three different paths P5, P6, P7. In this embodiment, once the chain 410 reaches a crossroads of the three paths P5, P6, P7, two gears are powered in opposite direction to direct the chain in either one of those paths. For instance, to direct the chain in the vertically upward path P5, the two gears between which the vertically upward path P5 is defined may be powered to move the chain in said path. Similarly, to direct the chain in the horizontal path P6, the two gears between which said path is defined are powered, and so on for the vertically downward path P7. Once the chain is engaged in one of these three paths P5, P6, P7, a third gear may be powered to move the chain. For instance, when the chain engages any of these three paths P5, P6, P7, the two gears that define the original path P0 containing the chain as it reaches the crossroads of the three paths P5, P6, P7 may be powered to move the chain.

In the embodiment shown, at least some of the gears of the matrix are arranged to form a path between a pair of adjacent ones of the gears to lead to three distinct paths P5, P6, P7 with other adjacent ones of the gears, one of the three distinct paths defined by two of the gears, the two of the gears including, for the path P5 or P7, one of the pair of the adjacent ones of the gears and another gear, or, for the path P6, two other gears, each of the two other gears adjacent a respective one of the gears of the pair of adjacent ones of the gears. The pair of adjacent ones of the gears defining the original path P0.

Figure 23:
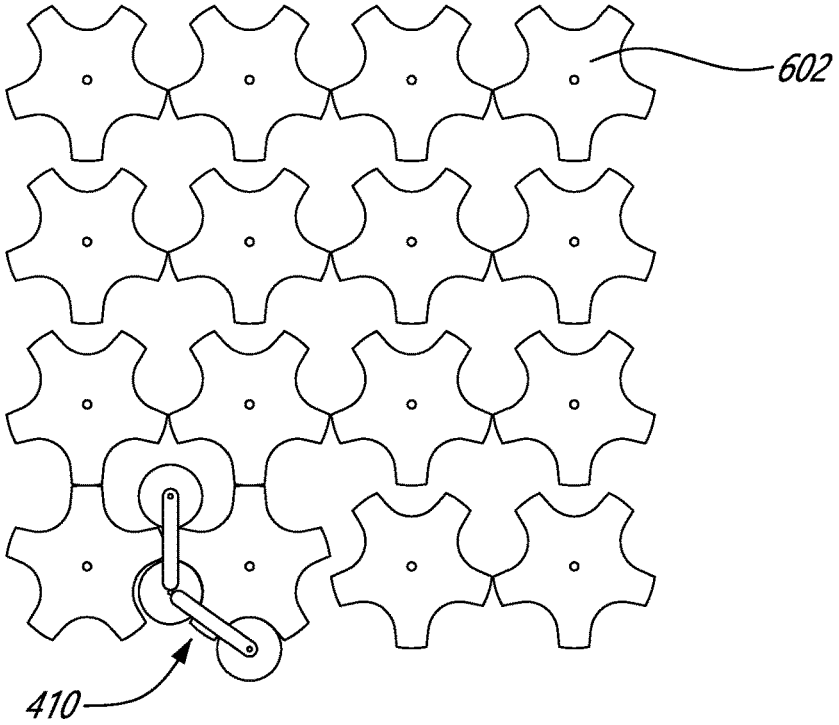
FIG. 23 is a top view of a matrix of gears disposed in a square arrangement in accordance with one embodiment, each of the gears having five notches.

Referring to FIG. 23, a matrix of gears 602 disposed in a row-and-column fashion is shown. The gears 602 have five notches each. Each of the gears 602 is individually motorized to displace the chain 410 on the support structure. The sequence of movements described above with reference to FIG. 22 may apply to this particular matrix of gears 602.

Figure 24:
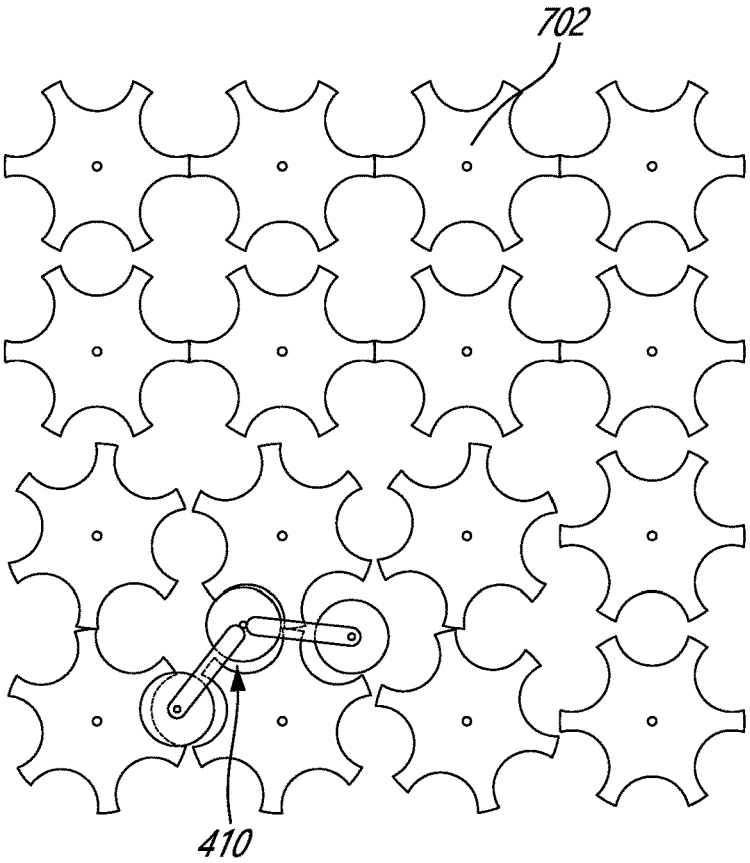
FIG. 24 is a top view of a matrix of gears disposed in a square arrangement in accordance with one embodiment, each of the gears having six notches.

Referring to FIG. 24, a matrix of gears 702 disposed in a row-and-column fashion is shown. The gears 702 have six notches each. Each of the gears 702 is individually motorized to displace the chain 410 on the support structure. The sequence of movements described above with reference to FIG. 22 may apply to this particular matrix of gears 702.

Figure 25:
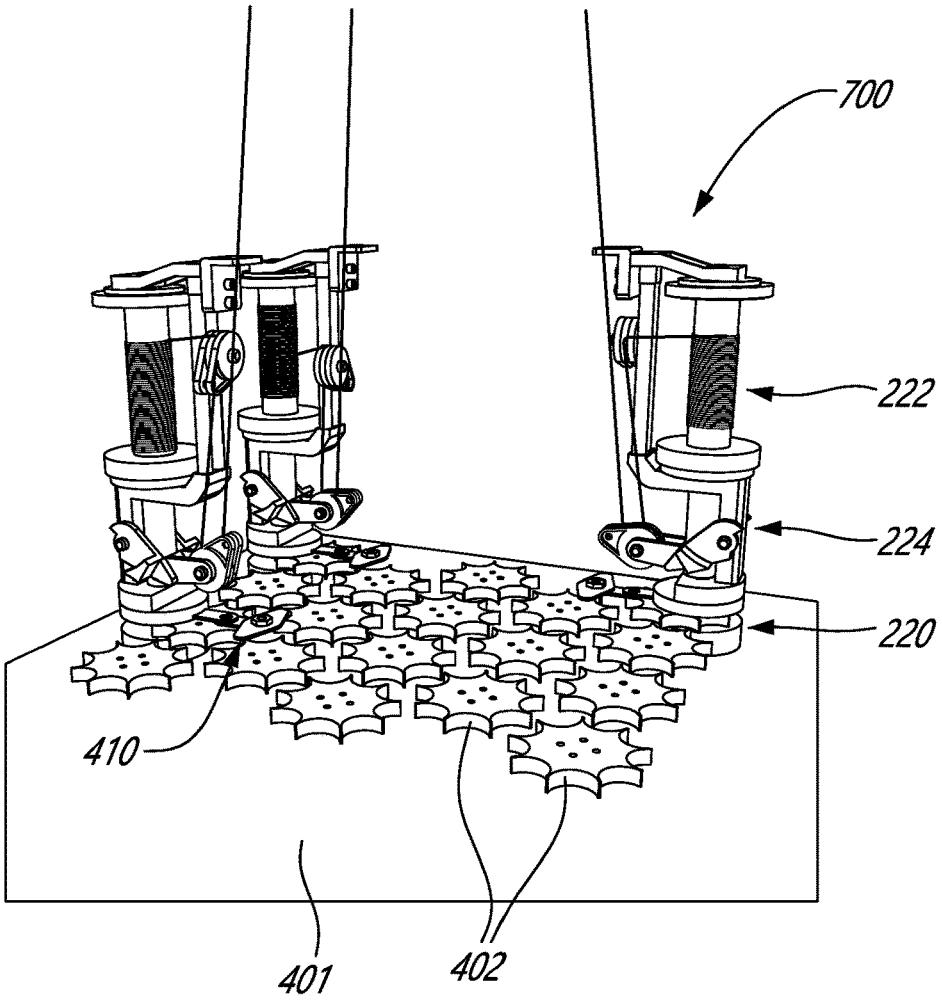
FIG. 25 is a three dimensional view of a braiding machine using the carriers of FIG. 11 and the matrix of gears of FIG. 21.

Referring now to FIG. 25, a braiding machine is shown at 700 and includes the carriers 220, three in the embodiment shown, having a tensioner 224 and a spool 222. Each of the carriers 220 is secured to a respective chain 410. A support structure 401 supports a plurality of the gears 402 described above with reference to FIG. 13. The gears 402 are disposed in a hexagonal manner as illustrated in FIGS. 13 and 21.

Figure 26:
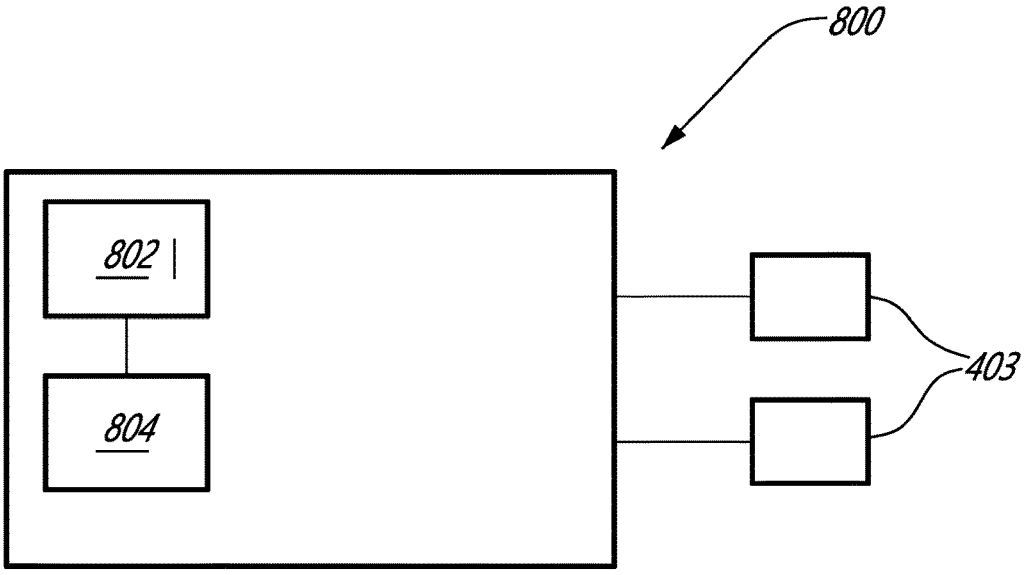
FIG. 26 is a schematic view of a controller for the braiding machine of FIG. 25.

Referring to FIG. 26, a controller for the braiding machine 700 is shown at 800. The controller 800 includes a processing unit 802 and a computer-readable medium 804 operatively connected to the processing unit 802. The controller 800 is operatively connected to the motors 403 of the gears 402 for controlling rotation of the gears 402 following instructions. Individually controlling of the gears may include powering a first one of the gears to orient the carrier toward one of the at least two distinct paths and powering at least a second one of the gears distinct than the first one of the gears for moving the carrier in the one of the at least two distinct paths.

That is, the computer-readable medium 804 may have stored thereon instructions characteristics of a given braid geometry to be created. These instructions may include a sequence of movements to be carried by each of the carriers 220 to achieve the braid geometry. The controller 800 therefore execute the instructions and control rotation of the gears 402 with their respective motors 403 to move the different carriers 220 with respect to the sequence of movements.

The controller 800 is configured for rotating the gears by powering the motors 403 for moving the chains 410 on the support structure 401 to braid the yarns. The controller 800 may be configured to obtaining data about a desired braid geometry. The data about the desired braid geometry may include obtaining data about a sequence of movements of the gears to move the chains on the support structure to obtain the desired braid geometry. The controller 800 may be able to create the sequence of movements in function of a desired braid geometry.

In a particular embodiment, the controller 800 of the gears 403 is operatively connected to the controllers 31 of each of the carriers 20 to allow a control of the tension the yarn in function of the position of the carriers 20 on the support structure, a speed of the carriers 20, and any other suitable properties.

Figure 27:
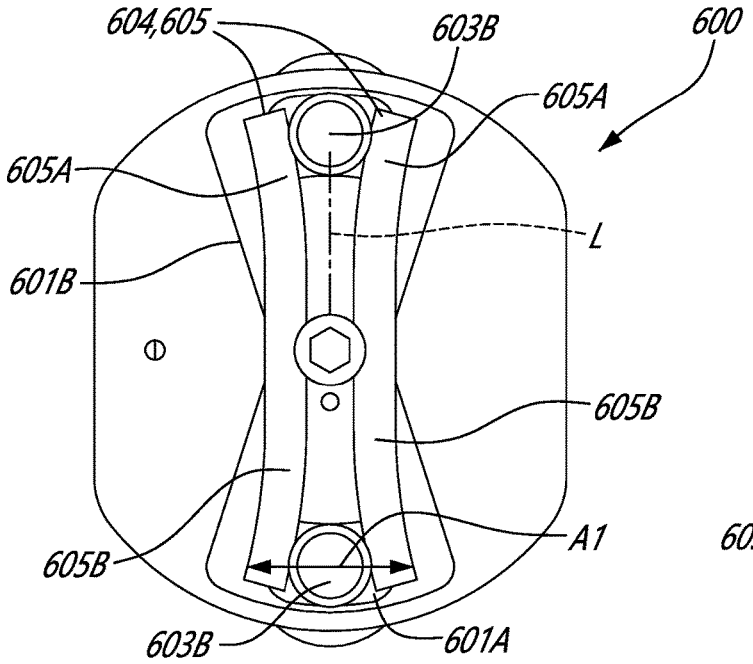
FIG. 27 is a top partially transparent view of a link in accordance with another embodiment.
Figure 28:
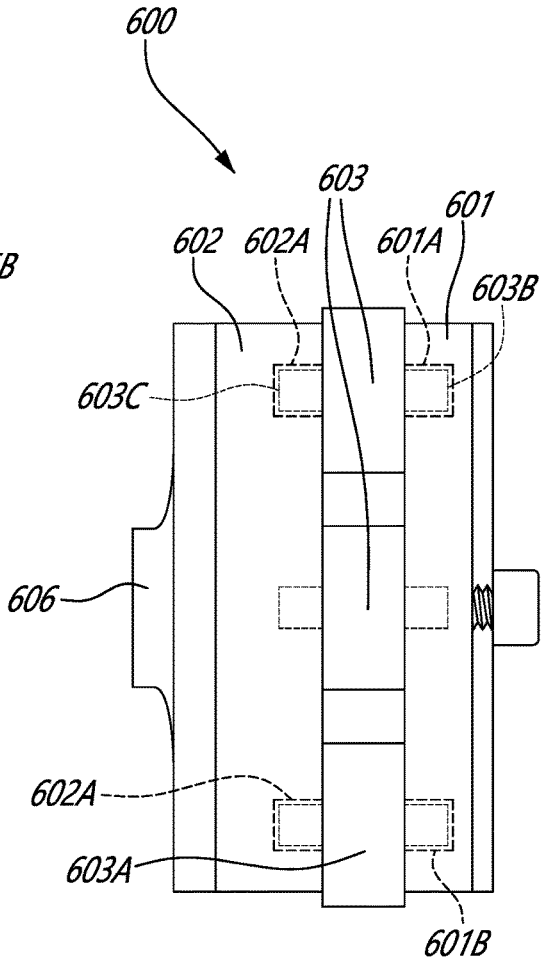
FIG. 28 is a side view of the link of FIG. 27.
Figure 29:
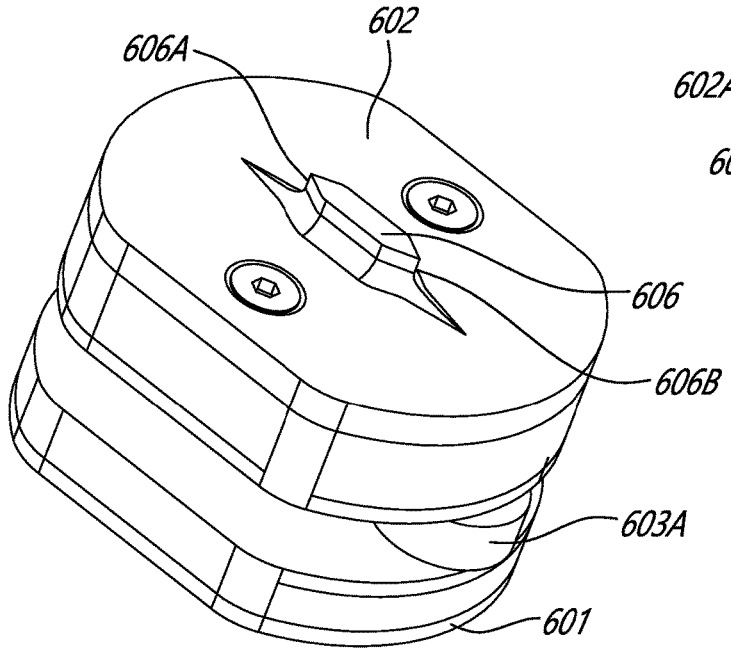
FIG. 29 is a bottom three dimensional view of the link of FIG. 27.

Referring now to FIGS. 27 to 29, another embodiment of a link is shown at 600. The link 600 includes a top plate 601 and a bottom plate 602. Top and bottom do not necessarily entail a given orientation of the link 600. Rollers 603, three in the embodiment shown, are disposed between the top plate 601 and the bottom plate 602. The rollers 603 includes a central roller and two lateral rollers. Each of the two lateral rollers 603 includes a central section 603A, a top shank 603B and a bottom shank 603C. The top and bottom shanks 603B, 603C extend away from one another and protrude from the central section 603A. Portions of the rollers 603 located between the two plates are sized to be engaged by teeth of gears as will be discussed below.

A central one of the rollers 603 remains substantially immobile relative to the top and bottom plates 601, 602. The lateral ones of the rollers 603 are able to move along direction depicted by arrow A1 in relationship to the top and bottom plates 601, 602. In this regard, each of the top and bottom shanks 603B, 603C of the lateral rollers 603 rides within slots 601A, 602A defined by the top and bottom plates 601, 602. These slots 601A, 602A extend generally transversally to a longitudinal axis L along which the rollers 603 are distributed. The slots may be curvilinear, but any suitable shape is contemplated.

In the embodiment shown, biasing members 604 are used to bias the lateral rollers 603 toward a central position, a.k.a., neutral position, in which they are substantially centered within their respective slots 601A, 602A and aligned with the longitudinal axis L. The biasing members 604 includes herein biasing rods 605 that are fixedly secured at their center to one or both of the top and bottom plates 601, 602. Each of the two biasing rods 605 therefore defines two cantilevered rod portions 605A, 605B. The cantilevered rod portions 605A, 605B are able to exert a force on the top shanks 603B of the lateral rollers 603. The biasing rods 605 are able to ride within a recess 601B, which may be shaped like a bowtie, and defined by the top plate 601. In some embodiments, two additional rods may be mounted within a similar recess defined by the bottom plate 602. As an alternative, leaf springs may be used as well.

The link 600 includes a guiding foot 606, or guide 606, that protrudes from the bottom plate 602. The guiding foot 606 includes a front wedge 606A and a rear wedge 606B that may assist in guiding the link 600 within a correspondingly sized track as will be discussed below. The guiding foot 606 may be connected to the bottom plate 602 via fillets. Any suitable shape of the guiding foot 606 is contemplated.

It will be appreciated that a link may include more than three rollers. For instance, a link with five rollers, hence with five axes, may be used without departing from the scope of the present disclosure. More or less rollers may be used.

Figure 30:
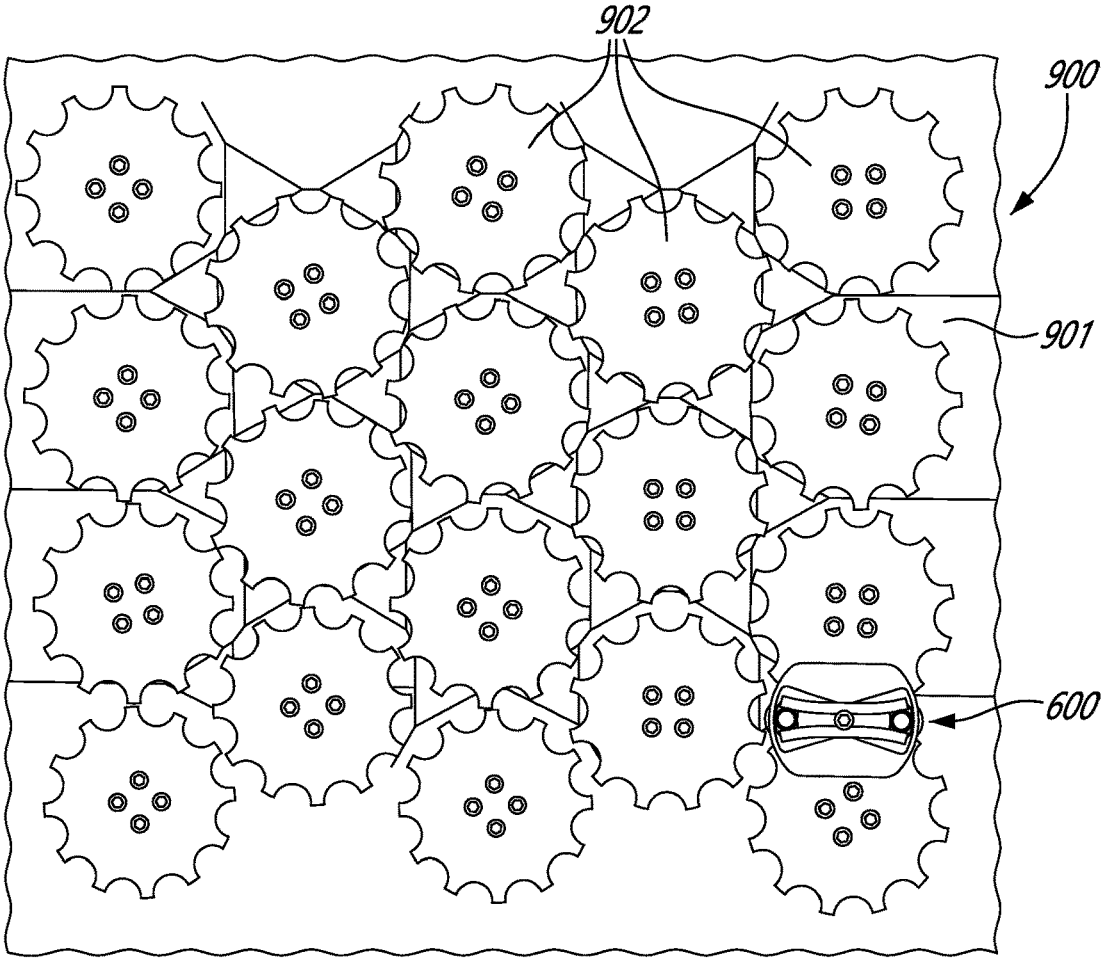
FIG. 30 is a top view of a matrix of gears to engage the link of FIG. 27.
Figure 31:
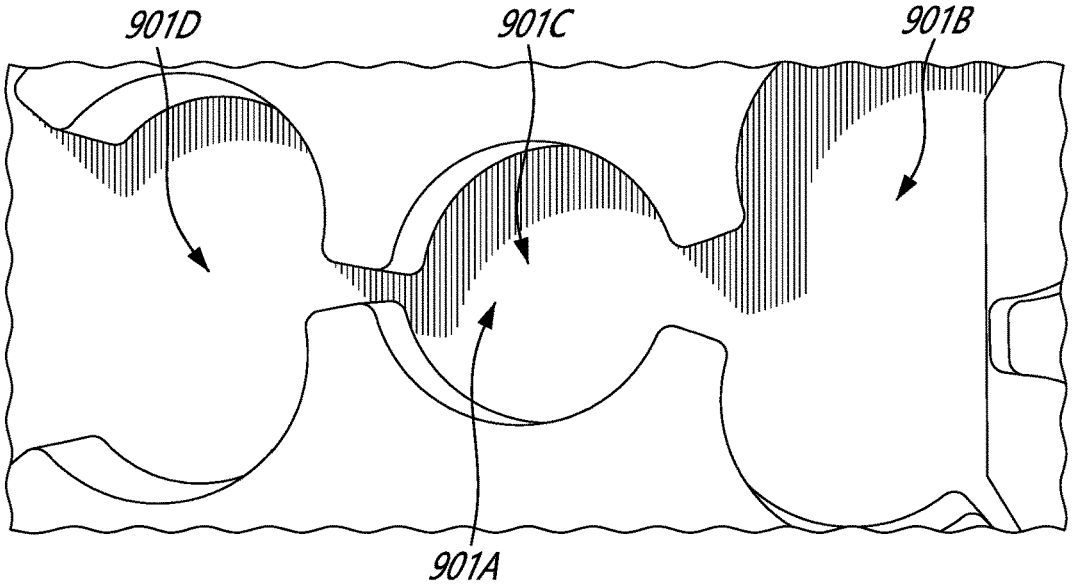
FIG. 31 is an enlarged view of the matrix of FIG. 30.

Referring now to FIGS. 30-31, a matrix of gears is shown at 900. The matrix 900 includes a plate 901 and a plurality of gears 902 rollingly engaged to the plate 901 for rotation about respective rotation axes. In the present embodiment, the gears 902 include each twelve teeth, but more or less teeth are contemplated. Each of the gears 902 may be individually controlled for moving the link 600 along a desired path. The gears 902 are herein disposed in a plurality of rows with the gears of two adjacent rows being staggered.

As shown in FIG. 31, the plate 901 defines a plurality of tracks 901A. Each of the tracks 901A is sized to accept the guiding foot 606 of the link 600. The tracks 901A have a convergent section 901B, a straight section 901C, and a divergent sections 901D. The straight section 901C is located between the convergent and divergent sections 901B, 901D such that the convergent section 901B converges toward the straight section 901C, which then opens to the divergent section 901D. A width of the straight section 901C is sized to accommodate the guiding foot 600. It will be appreciated that shapes of the different sections of the tracks 901 may be adjusted if need be.

In use, the guiding foot 606 enters the convergent section 901B and is guided toward the straight section 901C, which registers with a location where two adjacent gears are the closest to one another. When it exits the straight section 901C, the divergent section 901D allows the link to move along either one of the two possible directions depending of the rotation of the gears 902. When such engagement is achieved, the link 600 is constrained to movement in a single translational degree of freedom.

The track 901A may help in guiding the links 600 namely during their transition between the different gears 902. This may prevent the links 600 from getting stuck between the gears 902. Therefore, when the guiding foot 600 is located within the straight section 901C of the track 901A, it becomes constrained to a single degree of freedom, thereby reducing the risk of the link 600 getting blocked.

Because of the track 901A in the plate 901, it may be possible to increase a number of the teeth of the gears 902, and, consequently, to increase a number of the notches defined between the teeth of the gears 902. Herein, the gears 902 have 12 notches, but they may have more or less notches. In some embodiments, gears with twenty four notches may be used. These twenty four notch gears may be used with links having 5 rollers. In some embodiments, the notches of the gears may be deeper or shallower than illustrated in FIG. 30 and they may have a different shape than circular. This may improve the overall operation of the braiding machine. Roundover, chamfers, geometrical modifications of the notch may be used to smooth operation of the braiding machine as along as the rollers are able to easily enter the notches of the gears.

To control the gears 902, a controller, such as the controller 800 described above with reference to FIG. 26, is able to receive a geometric representation of a structure to be braided; to extract trajectories of the different yarns to obtain the braided structure; to convert these extracted trajectories into link trajectories of the links 600, and of the carriers 20, 120, 220 mounted to these links 600; and to control rotation of the different gears 902 to move the links 600 per the link trajectories. The algorithm may ensure that the different links 600 do not bump into one another, are not simultaneously on the same notch of the same gear 902.

As can be seen therefore, the examples described above and illustrated are intended to be exemplary only. The scope is indicated by the appended claims.

What is claimed is:

1. A braiding machine, comprising:

a support structure;

a matrix of gears supported by the support structure, the gears being rotatable about respective rotation axes, the gears engageable to a carrier carrying a yarn for moving the carrier on the support structure, at least some of the gears of the matrix arranged to form a path between a pair of adjacent ones of the gears, wherein the gears of the pairs of adjacent ones have the same number of notches;

bi-directional motors drivingly engaged to at least some of the gears; and a controller operatively connected to the motors, the controller having a processor and a computer-readable medium operatively connected to the processor and having instructions stored thereon executable by the processor for individually controlling the gears by powering the motors for moving the carriers on the support structure to braid the yarns.

2. The braiding machine of claim 1, comprising chains each having at least three rollers interconnected by at least two arms, the at least two arms pivotable one relative the other about at least one pivot axis normal to the plane, the at least three rollers engageable within notches of the gears for moving the chains on the support structure.

3. The braiding machine of claim 2, comprising the carriers, the carriers having spools carrying the yarns to be braided, the carriers secured to the chains.

4. The braiding machine of claim 2, wherein a diameter of the notches corresponds to a diameter of the rollers, a depth of the notches corresponding to a radius of the rollers.

5. The braiding machine of claim 1, wherein the controller is configured for obtaining data about a desired braid geometry.

6. The braiding machine of claim 5, wherein the obtaining of the data includes obtaining data about a sequence of movements of the gears to move the carriers engaged to the gears to obtain the desired braid geometry.

7. The braiding machine of claim 1, wherein the gears of the matrix are distributed along rows and columns, a distance between two adjacent gears of the same row corresponding to a distance between two adjacent gears of the same column.

8. The braiding machine of claim 1, wherein the controlling of the gears includes rotating a first gear to steer one of the carriers in a given direction and rotating second and third gears for moving the one of the carriers in the given direction.

9. The braiding machine of claim 1, wherein the individually controlling of the gears including powering a first one of the gears to orient the carrier toward one of the at least two distinct paths and powering at least a second one of the gears distinct than the first one of the gears for moving the carrier in the one of the at least two distinct paths.

* * * * *